US012727630B2

(12) United States Patent
Cross et al.

(10) Patent No.: US 12,727,630 B2
(45) Date of Patent: Sep. 8, 2026

(54) HAND-ENGAGING DEVICES WITH TRACTION-ENHANCING FEATURES

(71) Applicant: NIKE, Inc., Beaverton, OR (US)

(72) Inventors: John W. Cross, Portland, OR (US); Eun Kyung Lee, Beaverton, OR (US); Daniel P. Morgan, Beaverton, OR (US); Garrett T. Sutherlin Santo, Portland, OR (US); Paul Sutherlin Santo, Portland, OR (US); Todd Anthony Waatti, Battleground, WA (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/913,401

(22) Filed: Oct. 11, 2024

(65) Prior Publication Data

US 2026/0101943 A1 Apr. 16, 2026

(51) Int. Cl.
*A41D 13/08* (2006.01)
*A41D 13/00* (2006.01)

(52) U.S. Cl.
CPC ..... *A41D 13/081* (2013.01); *A41D 13/0002* (2013.01); *A41D 2400/80* (2013.01); *A41D 2500/50* (2013.01)

(58) Field of Classification Search
CPC ..... A41D 13/081; A41D 2400/80; A41D 13/0002; A41D 2500/50; A41D 19/01547; A41D 19/01558; A41D 19/01564; A61G 5/10; A63B 60/06
See application file for complete search history.

(56) References Cited

U.S. PATENT DOCUMENTS 753,970 A * 3/1904 Foster ..... D06C 11/00 15/186
2,409,365 A * 10/1946 Lamb ..... A61H 3/02 135/65
4,884,374 A * 12/1989 Natale ..... A46B 5/04 451/523
6,610,382 B1 * 8/2003 Kobe ..... A63B 60/10 428/104
2003/0037364 A1 * 2/2003 Albert ..... A63B 71/148 2/161.1
2004/0107982 A1 * 6/2004 Morris ..... A61H 3/0288 135/77
2010/0183814 A1 * 7/2010 Rios ..... A63B 60/00 427/387

* cited by examiner

*Primary Examiner* — Khoa D Huynh
*Assistant Examiner* — Erick I Lopez
(74) *Attorney, Agent, or Firm* — Banner & Witcoff, Ltd.

(57) ABSTRACT

Hand-engaging devices include: (a) a base member having a first side for engaging a user's hand and an opposite second side providing a mount surface; and (b) a traction pad engaged with the mount surface. The traction pad may include a base surface and plural traction elements extending outward from the base surface. The traction elements may include a free end and/or a free edge spaced apart from the base surface. In some examples, a first set of the plural traction elements may include a one-piece structure forming a traction element base extending along a portion of the base surface of the traction pad and first and second traction elements. Each of these traction elements may extend away from the traction element base, through the base surface, and to a free end of the traction element that is spaced from an exposed face of the base surface.

20 Claims, 15 Drawing Sheets

HAND-ENGAGING DEVICES WITH TRACTION-ENHANCING FEATURES

FIELD OF THE INVENTION

The present technology relates to the field of hand-engaging devices, such as gloves, that include traction-enhancing features. The hand-engaging devices may be well suited for use in engaging and propelling objects with the hand, such as a pushrim of a wheelchair. Some more specific aspects of the present technology pertain to hand-engaging devices (such as gloves) that include traction elements that may be structured and oriented to apply force to propel a wheelchair forward and/or move another object. At least some aspects of the present technology may be well suited for use by athletes competing in racing events and/or other athletic events.

BACKGROUND

Various types of wheelchair gloves, including wheelchair racing gloves, are known. While such gloves have different types of traction elements, the gloves typically are optimized for use under certain conditions (e.g., best suited for use in dry conditions).

TERMINOLOGY

Some general terminology and information is provided that will assist in understanding various portions of this specification and the invention(s) as described herein.

This application and/or claims use the adjectives, e.g., "first," "second," "third," and the like, to identify various components and/or features relating to this technology. These adjectives are used merely for convenience, e.g., to assist in maintaining a distinction between various components and/or features of a specific structure. Use of these adjectives should not be construed as requiring a specific order or arrangement of the components and/or features being discussed. Also, use of these specific adjectives in the specification for a specific structure does not carry over into the claims (e.g., a component or feature referred to as the "third" in the specification may correspond to any numerical adjective used for that component or feature in the claims).

The technology described herein relates to devices that are engageable with a user's hand. The term "rearward" as used herein with respect to features of a hand-engaging device means at or in a direction toward a portion of the device where a user's wrist would be located when engaged with the device for use. The term "forward" as used herein with respect to features of a hand-engaging device means at or in a direction away from where a user's wrist would be located when engaged with the device for use.

Various features of this technology are described as being possessed by or included with a "first set" of a plurality of traction elements included with a hand-engaging device. A "first set," unless otherwise specified, may include any portion or proportion of the plurality of traction elements included in the hand-engaging device. In some examples, a "first set" of the plurality of traction elements will include at least two traction elements provided in the hand-engaging device, up to 100% of the traction elements included in the hand-engaging device.

SUMMARY

The present technology relates to hand-engaging devices (e.g., devices that can be worn on the hand and/or grasped by the hand), such as gloves, that include traction-enhancing features. The hand-engaging devices include features for use in engaging and propelling objects with the hand, such as a pushrim of a wheelchair. Some more specific aspects of the present technology pertain to hand-engaging devices (such as gloves) that include traction elements that may be structured and oriented to apply force to propel a wheelchair forward and/or move another object. The traction elements may comprise one-way traction elements.

Hand-engaging devices in accordance with at least some examples of this technology include: (a) a base member having a first side configured to engage a user's hand and a second side opposite the first side (e.g., wherein the second side may include a mount surface); and (b) a traction pad engaged with the second side of the base member (e.g., with the mount surface). The traction pad includes a base surface and a plurality of traction elements extending outward from the base surface. The plurality of traction elements include at least one of a free end or a free edge spaced apart from the base surface. The plurality of traction elements may provide "one-way traction," e.g., a high level of frictional engagement when a force is applied against a surface (e.g., a rubber or thermoplastic elastomer surface) in a first direction and a low level of frictional engagement when the same level of force is applied against the surface in at least one other direction (e.g., in an opposite direction from the first direction).

Hand-engaging devices in accordance with at least some examples of this technology may include: (i) a base member having a first side configured to engage a user's hand and a second side opposite the first side, wherein the second side includes a mount surface; and (ii) a traction pad engaged with the mount surface, wherein the traction pad includes a base surface and a plurality of traction elements extending outward from a first side of the base surface. A first set of the plurality of traction elements includes plural traction element components having a one-piece structure (also called a "unitary structure" herein), the one-piece structure comprising: (a) a traction element base extending along a portion of a second side of the base surface of the traction pad located opposite the first side of the base surface, (b) a first traction element extending away from the traction element base and through the base surface from the second side of the base surface to the first side of the base surface and to a first free end of the first traction element that is spaced apart from the first side of the base surface, and (c) a second traction element extending away from the traction element base and through the base surface from the second side of the base surface to the first side of the base surface and to a second free end of the second traction element that is spaced apart from the first side of the base surface. The plurality of traction element components having this one-piece structure (i.e., a unitary, single piece construction) may have a shape akin to a staple and/or they may be arranged to provide one-way traction.

Hand-engaging devices in accordance with at least some examples of this technology may include one or more of: (a) a recessed groove provided in the base surface of the traction pad and/or a mount surface of the base member (e.g., for engaging a pushrim of a wheelchair); (b) a handle provided for engagement by a user's hand; (c) a securing strap for securing to a user's hand; (d) weight savings features; (e) comfort enhancing features; and/or (f) a fluid-filled bladder component (e.g., underlying the base surface of the traction pad).

Additional aspects of this technology relate to manners of making and/or using hand-engaging devices of the types described above and/or those described in more detail below.

Given the above Summary and general description of aspects, features, and examples of this technology, a more detailed description of specific examples of hand-engaging devices, and/or component parts thereof in accordance with examples of this technology and this invention follows.

BRIEF DESCRIPTION OF THE DRAWINGS

The foregoing Summary, as well as the following Detailed Description, will be better understood when read in conjunction with the accompanying drawings in which like reference numerals refer to the same or similar elements in all of the various views in which that reference number appears.

The reader should understand that the attached drawings are not necessarily drawn to scale. Also, where the drawings show a device for engaging one hand of a wearer (e.g., the left hand), those skilled in the art will understand that a hand-engaging device for the other hand of the wearer (e.g., the right hand) may constitute a mirror image of the device illustrated. Alternatively, if desired, hand-engaging devices for the right and left hands of a single user may have different structures in some examples of this technology (e.g., with the handle customized for the user's individual hands, to better match the way the user's individual hands approach and interact with a pushrim, etc.).

DETAILED DESCRIPTION

In the following description of various examples of gloves and hand-receiving device structures and components according to the present technology, reference is made to the accompanying drawings, which form a part hereof, and in which are shown by way of illustration various example structures and environments in which aspects of the invention may be practiced. It is to be understood that other structures and environments may be utilized, and that structural and functional modifications may be made from the specifically described structures and functions without departing from the scope of the present invention.

Referring to the figures and following discussion, various hand-engaging devices and components and/or features thereof in accordance with aspects of the present technology are disclosed. Concepts disclosed with respect to these devices, components, and/or features may be applied to a wide range of hand-engaging devices, such as gloves for wheelchair propulsion, wheelchair racing gloves, and the like. In addition, concepts relating to the present technology may be applied to other hand-engaging devices, such as hand-engaging devices used in propelling other types of vehicles and/or used in applying forces to other objects in other types of activities.

Figure 1A:
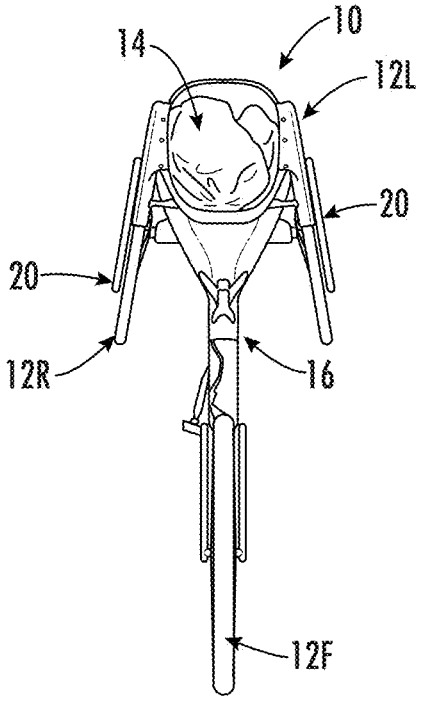
FIGS. 1A-1C illustrate features of a wheelchair with which aspects of this technology may be used.
Figure 1B:
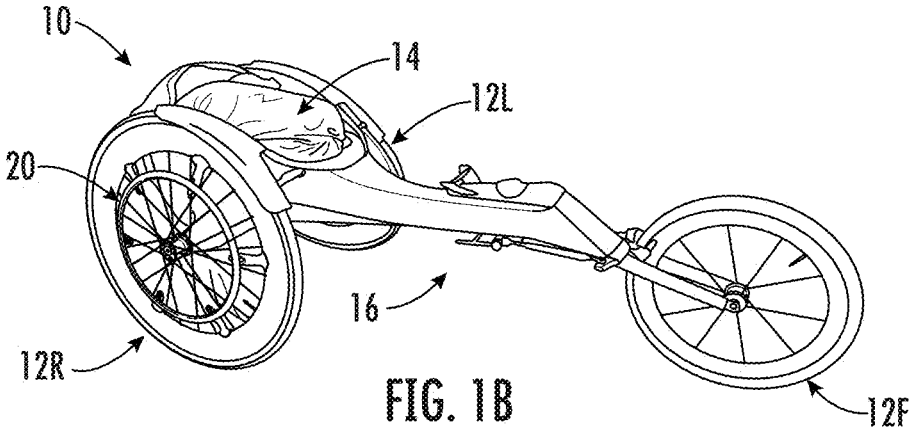

FIGS. 1A and 1B provide views of a wheelchair 10 that may be propelled using hand-engaging devices in accordance with aspects of this technology. This example wheelchair 10 includes two rear wheels 12R and 12L with a seat 14 located between them. The wheelchair 10 also includes a forward wheel 12F. The wheels 12R, 12L, and 12F (as well as their axles) and seat 14 are mounted to a frame 16 or chassis.

Figure 1C:
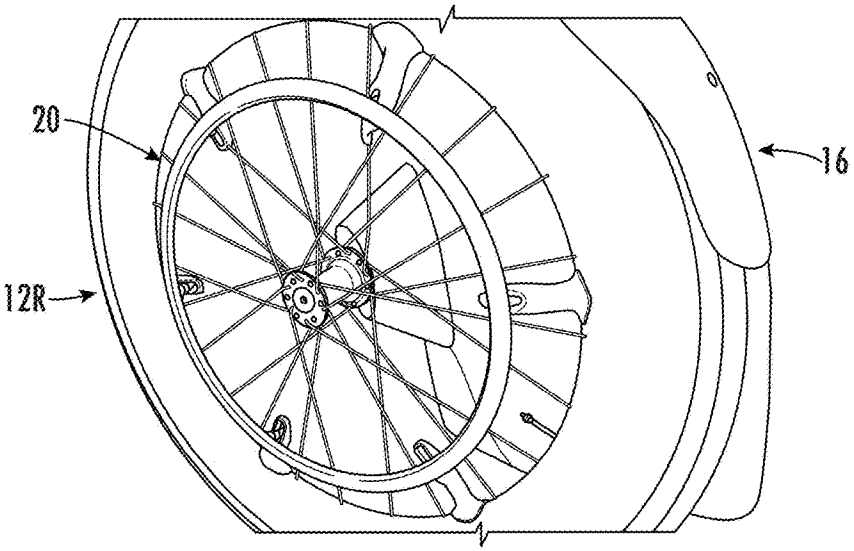

As also shown in FIG. 1C, each of the rear wheels 12R and 12L include a pushrim 20 (also called a "hand rim"). The pushrim 20 provides a surface that a user will engage with his/her hand to move the rear wheels 12R, 12L (and thus the wheelchair 10). Pushrim 20 may include a metal or plastic rim or tube that typically is circular in shape and has a diameter smaller than the wheel 12R, 12L diameter. At least the outer surface of the pushrim 20 may be formed from a rubber or thermoplastic elastomer material. The pushrim 20's rim or tube may have an outer diameter (through its cross-section) within a range of at least 6 mm to less than 25 mm.

Figure 1D:
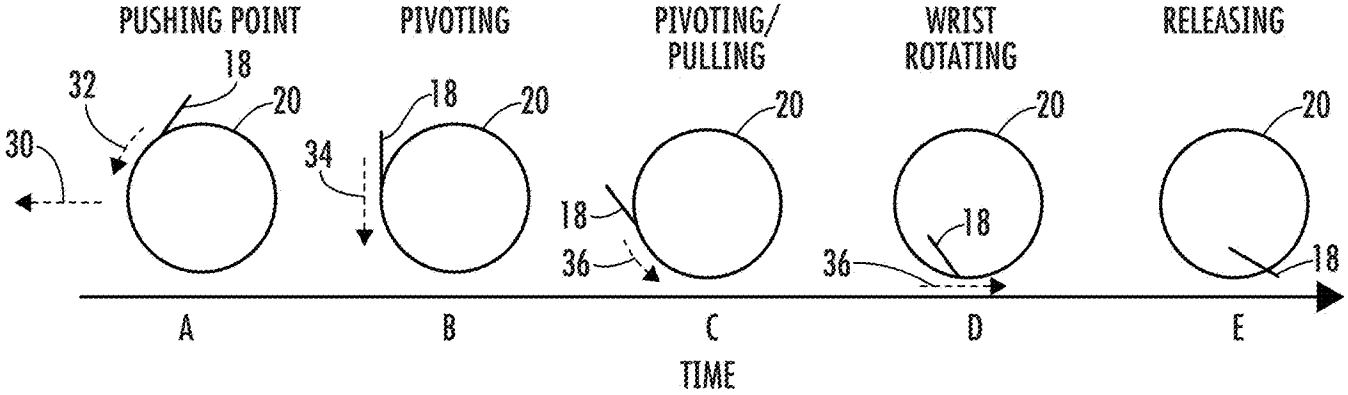
FIG. 1D illustrates features of engagement of a wearer's hand with the pushrim of a wheelchair during certain activities.

As noted above, the pushrim 20 provides a surface that a user will engage with his/her hand and to which a user will apply a force to move the rear wheels 12R, 12L (and thus the wheelchair 10). FIG. 1D generally illustrates how a user might engage a pushrim 20 to propel a wheelchair 10 in a forward direction 30, particularly when racing or trying to move at a rapid pace. At time A (an initial "push" or "pushing point" time), the user's hand (represented by reference number 18) engages the pushrim 20 for a push at approximately a "10 o'clock" position on the pushrim 20 and applies a rotary and/or pushing force 32 to the pushrim 20. Between times A and B, the user's wrist and/or hand 18 pivot to reach a fowardmost location of the pushrim 20's rotation and the force 34 applied to the pushrim 20 becomes more vertical (pushing the pushrim 20 downward). As rotation continues (between times B and C and between times C and D), the user's wrist and/or hand 18 may continue to pivot and the prior pushing force turns into more of a pulling force 36 (as the hand rotates around the pushrim 20). Finally, at time E, the user's hand 18 releases from the pushrim 20 (e.g., at about the "5 o'clock" position) and returns back to the pushing point shown at time A for the next propulsion cycle. This propulsion cycle repeats, on both wheels 12R and 12L, throughout the propulsion event.

Figure 2A:
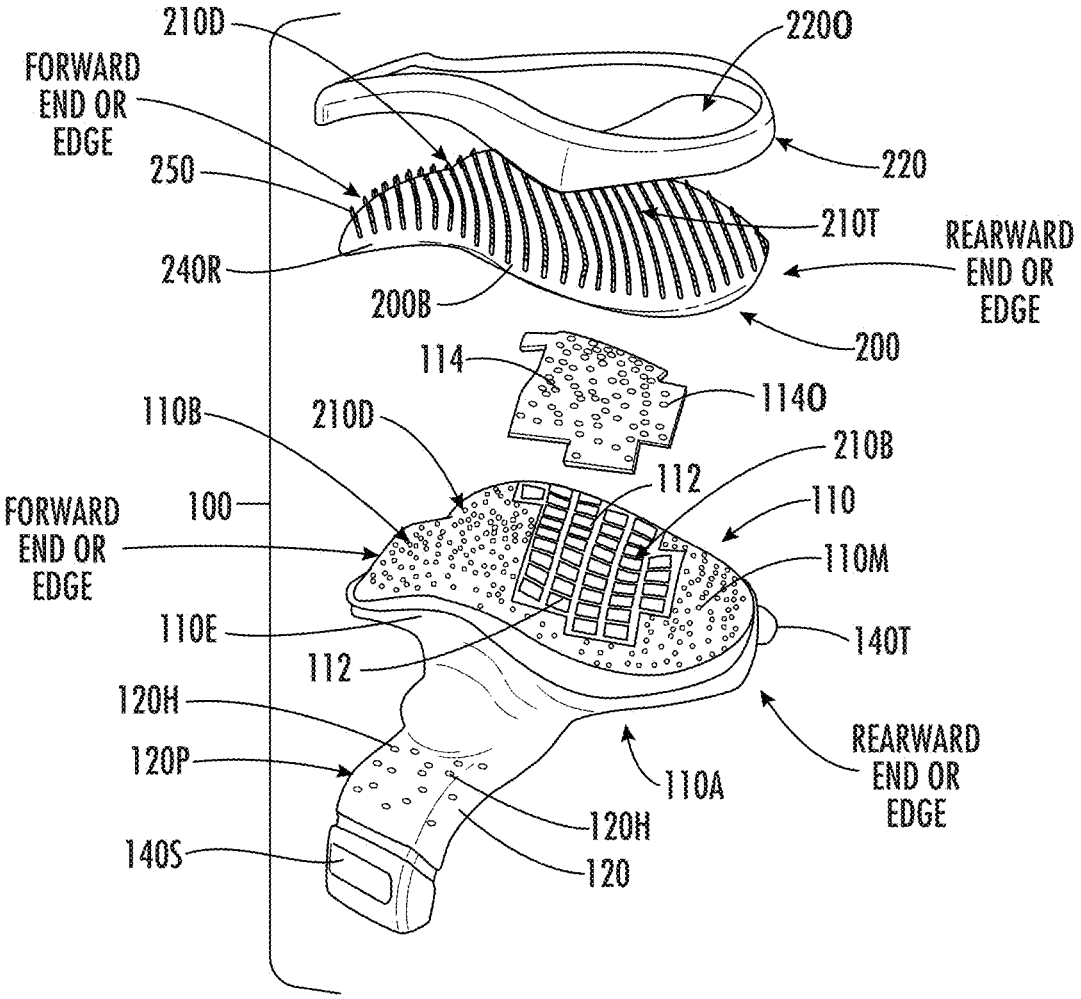
FIGS. 2A-2O illustrate features of hand-engaging devices and components thereof in accordance with at least some aspects of this technology.
Figure 2B:
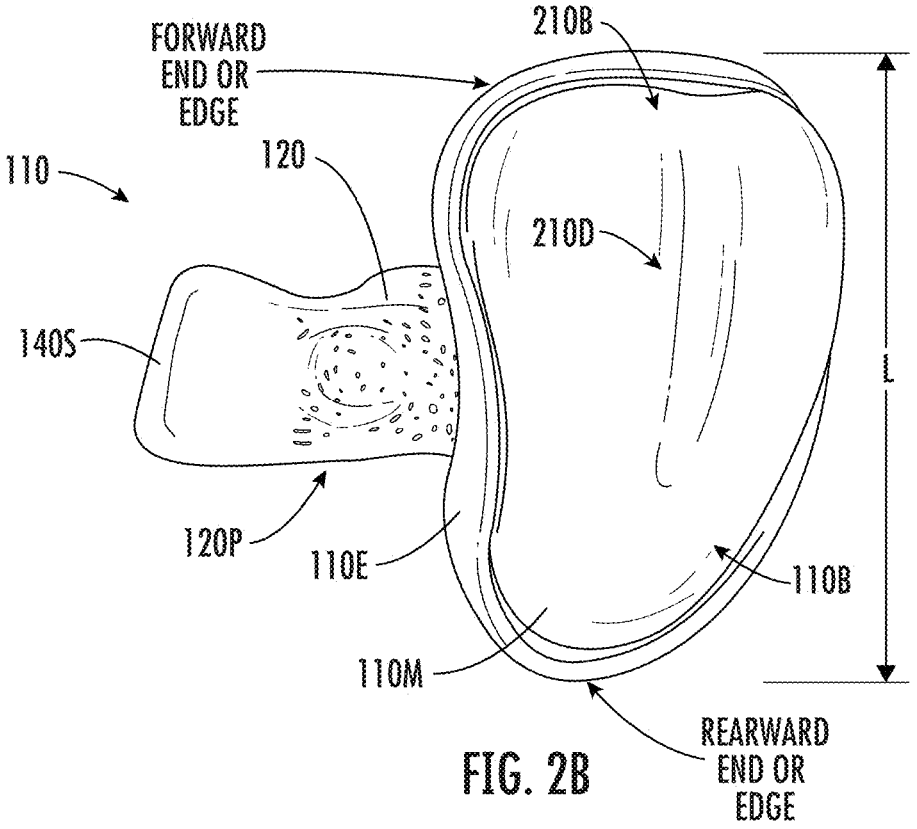
Figure 2C:
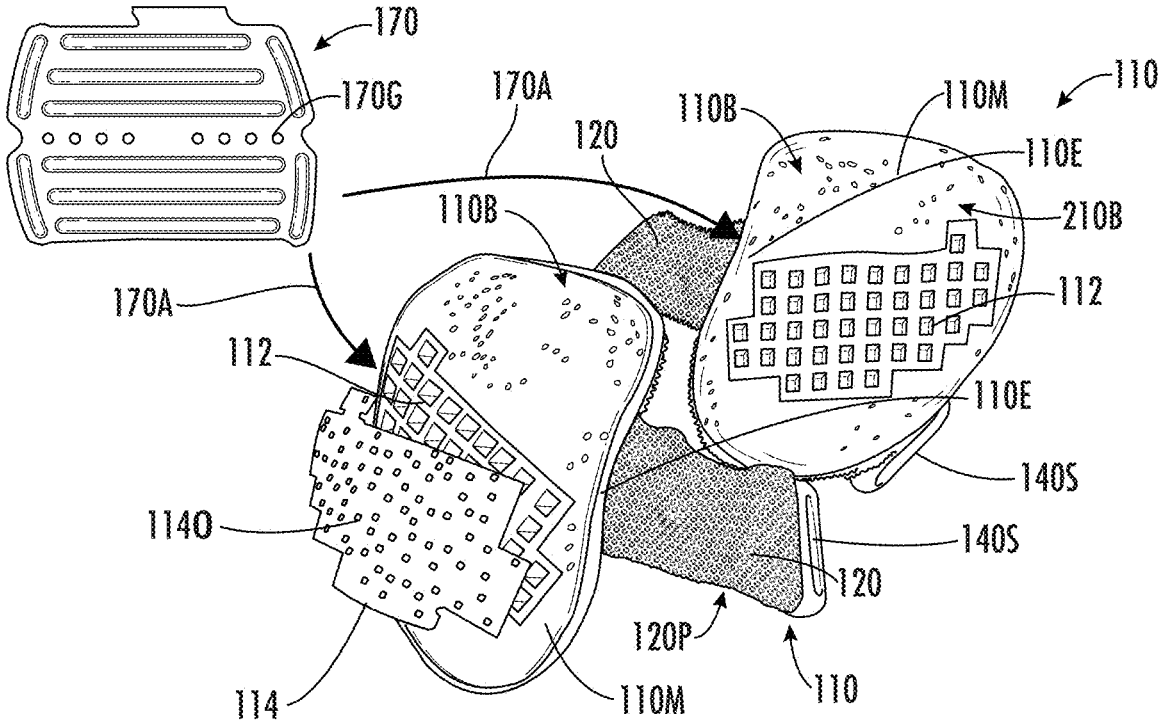
Figure 2D:
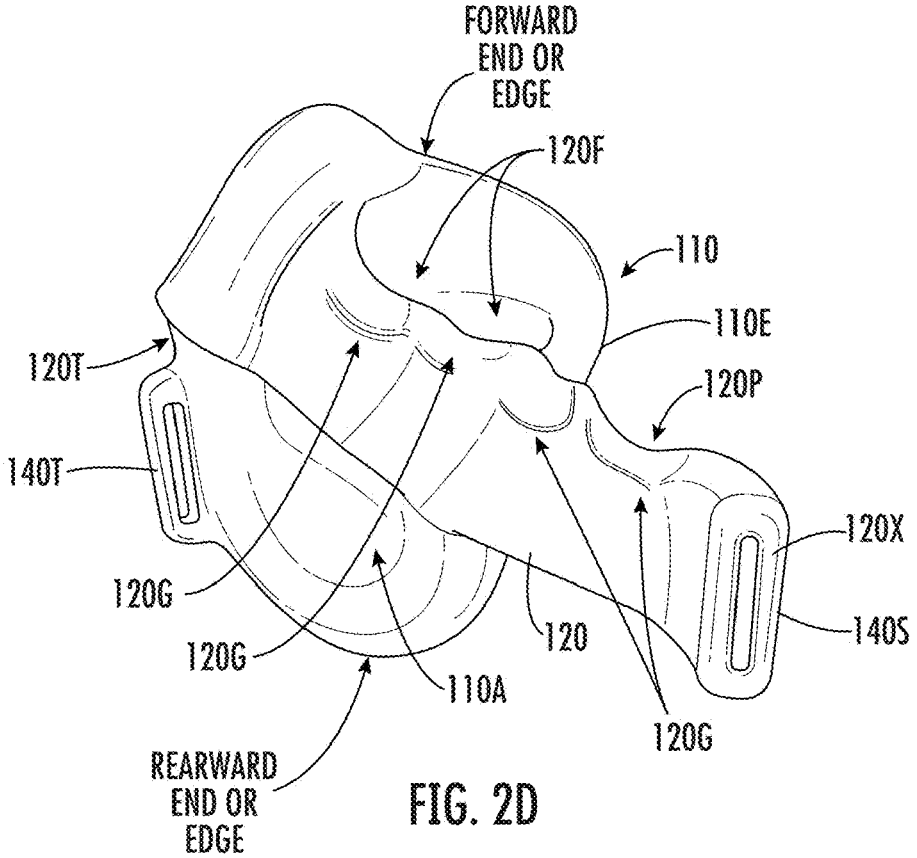
Figure 2E:
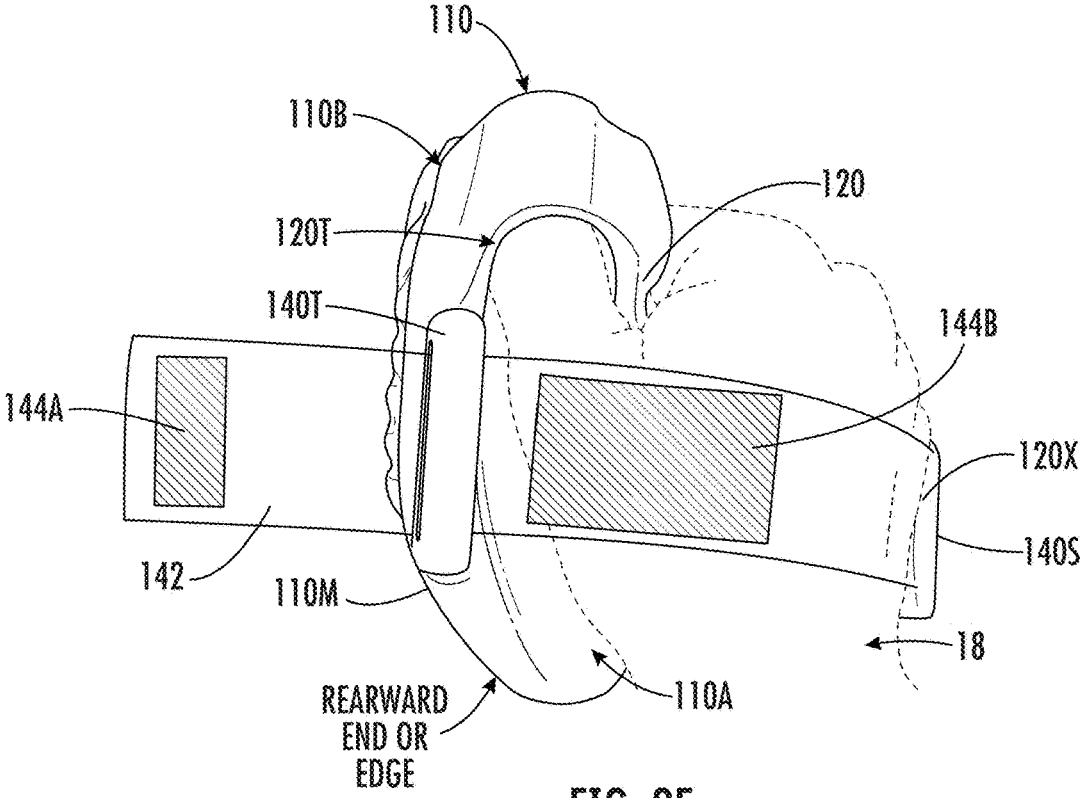
Figure 2F:
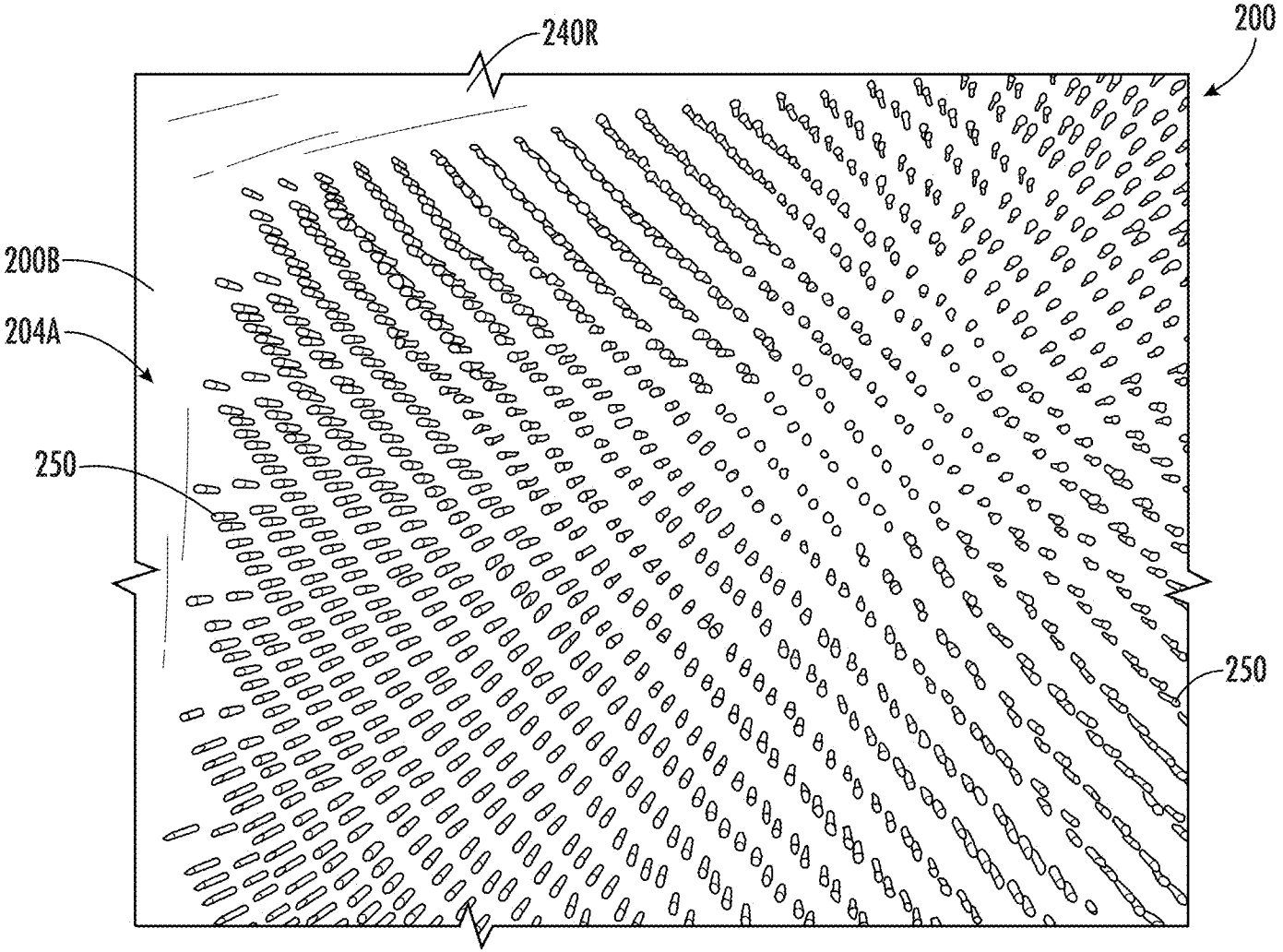
Figure 2G:
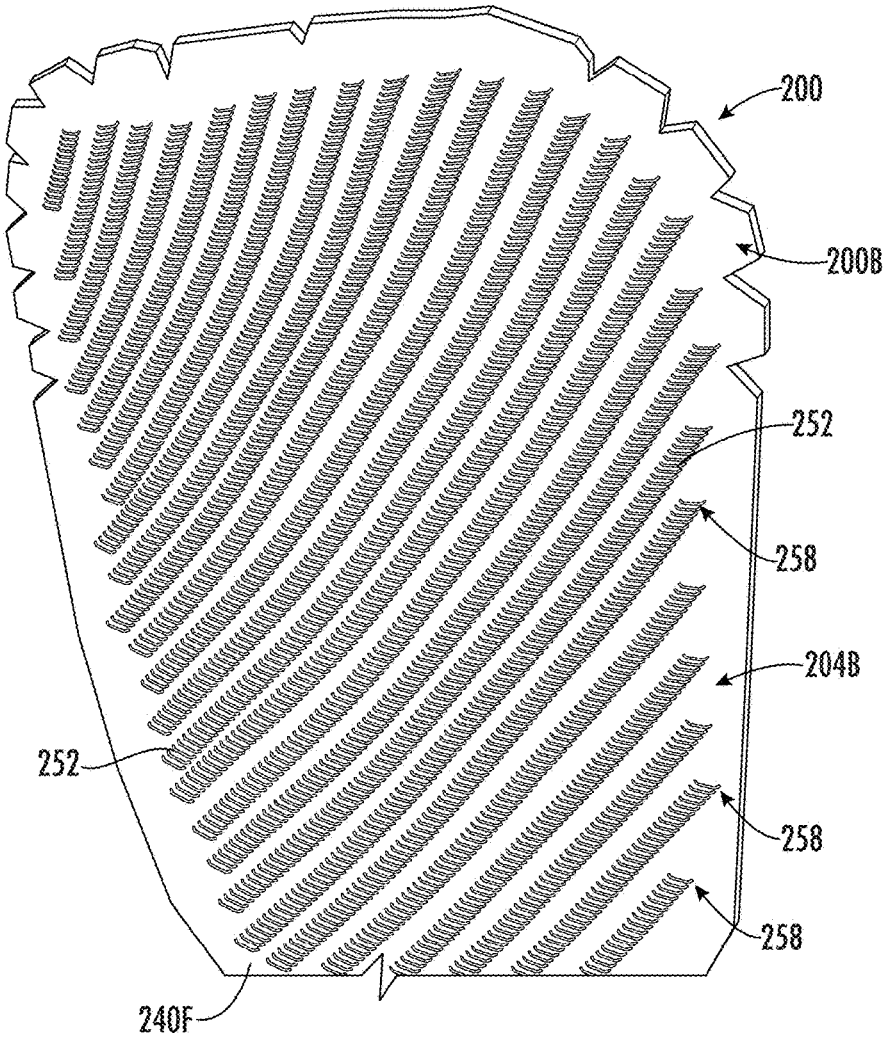

FIGS. 2A-2O show various views of an example hand-engaging device 100 and components thereof in accordance with at least some aspects of the present technology. Such hand-engaging devices 100 protect a user's hands and provide improved traction (i.e., traction between the hand-engaging device 100 and the pushrim 20 under wet and/or dry conditions) during propulsion activities of the types described above. FIG. 2A provides an exploded view of an example hand-engaging device 100; FIGS. 2B and 2C provide views of a base member 110 and its mount surface 110M in accordance with at least some examples of this technology; FIG. 2D provides a view of the first side of the base member 110 that is configured to engage a user's hand and FIG. 2E shows the base member engaged with a user's hand 18; and FIGS. 2F-2O show various features of a traction pad 200 that may be used in at least some examples of this technology.

FIG. 2A shows an exploded view of this example hand-engaging device 100. This hand-engaging device 100 includes base member 110 having a first side 110A configured to engage a user's hand 18 and a second side 110B opposite the first side 110A. The second side 110B includes a mount surface 110M on which a traction pad 200 is mounted. In this illustrated example, the mount surface 110M includes a plurality of recesses 112 and/or through holes defined in it (as also shown in FIG. 2C. The recesses 112 in this illustrated example are formed in a lattice or matrix structure (e.g., with parallel columns and/or rows of recesses 112), but any desired sizes, shapes, arrangements, and/or combinations of recesses 112 may be provided in other specific examples of this technology. The recesses 112 may be provided to control and/or reduce the weight of the base member 110. The recesses 112 may be covered by one or more cover members, such as cover plate 114, e.g., to provide a larger surface area onto which other parts (e.g., traction pad 200) can be secured (e.g., by adhesive). The cover plate 114 (when present) and the exposed surface of the second side 110B of the base member 110 may be considered the mount surface 110M of base member 110 in at least some examples of this technology. The cover plate 114 may be made from any desired materials (e.g., nylon materials, thermoplastic materials, other plastics, metal materials, metal alloy materials, etc.), and it may be glued and/or otherwise secured to the base member 110 over the recesses 112 (e.g., by mechanical fasteners, etc.). Additionally, if desired, the cover plate 114 may have one or more openings 114O defined through it, e.g., as shown in FIGS. 2A and 2C (e.g., to further reduce and/or control weight, control flexibility, promote flexion, etc.).

A traction pad 200 is engaged with the mount surface 110M, e.g., by one or more of an adhesive, mechanical fasteners, etc. The example of FIGS. 2A and 2F-2O shows the traction pad 200 in the form of a wire brush pad. While features of this example traction pad 200 will be described in more detail below in conjunction with FIGS. 2F-2O, as shown in FIG. 2A, the traction pad 200 includes a base surface 200B (e.g., formed from one or more layers) and a plurality of traction elements 250 extending outward from the base surface 200B. As will be described in more detail below, the plurality of traction elements 250 in the illustrated examples will include a free end 250E spaced apart from the base surface 200B.

FIG. 2A further shows that an outer perimeter(s) of the traction pad 200 and/or the mount surface 110M of the base member 110 may be covered with a perimeter element 220. The perimeter element 220 may be formed from a rubber or thermoplastic elastomeric material, e.g., and function as a bump shield. Additionally or alternatively, the perimeter element 220 may help hide the seam or junction between the traction pad 200 and the base member 110. In some examples of this technology, the perimeter element 220, when present, may be fixed to the traction pad 200 and/or the base member 110 by an adhesive and/or by one or more mechanical fasteners. The traction pad 200 and its traction elements 250 are exposed through an opening 220O in the perimeter element 220 in this example.

Features of this example base member 110 now will be described in more detail with additional reference to FIGS. 2B-2E. As shown, the first side 110A of the base member 110 of this example includes a handle 120. The entire base member 110 may be made from a nylon material, a polyurethane material, or other material, e.g., a material that is rigid and durable (e.g., a thermoplastic elastomer material, a thermosetting material, other plastic materials, metals or metal alloy materials, etc.). If necessary or desired, at least the handle 120 of the base member 110 (and/or at least some portions of the handle 120) may include (e.g., may be formed from, treated with, coated with) a tacky material and/or an elastomeric material (e.g., a rubber or rubberized material, a silicone material, etc.) at its outer surface, e.g., to provide better grip for the user, to prevent and/or deter the hand from slipping when grasping the handle, etc.

Additionally or alternatively, other grip-enhancing and/or slip-deterring features may be provided on the base member 110 and/or its handle 120 in some examples of this technology. In addition or as an alternative to the tacky, elastomeric, silicone, and/or rubberized material features described above, the base member 110 and/or its handle 120 may include one or more raised ridges, one or more recessed grooves, one or more raised nubs, texturing, and/or other structural features to enhance grip and/or reduce hand slip with respect to the handle 120. Still additionally or alternatively, the handle 120 may include shape features to enhance its engagement with the wearer's hand (e.g., finger grooves and/or finger receptacles, as discussed below). Different grip-enhancing and/or slip-deterring features may be provided for different use conditions (e.g., with base members 110 or handles 120 having one or more different type(s) of grip-enhancing and/or slip-deterring features for use in dry conditions versus wet conditions, for use in hot conditions versus cold conditions, etc.). Additionally or alternatively, different grip-enhancing and/or slip-deterring features may be provided for different types of uses (e.g., with different base members 110 or handles 120 targeted for use in sprint races versus distance races versus basketball or other sports versus everyday use, etc.).

As shown in FIGS. 2D and 2E, the first side 110A of the base member 110 may be formed to include or define a thumb-receiving chamber 120T. Additionally or alternatively, the first side 110A of the base member 110 may include a receptacle 120F located between an outer surface 120S of the handle 120 and the traction pad 200, and this receptacle 120F is configured to receive an end of at least one additional finger of the user's hand 18. In the illustrated example of FIG. 2D, the finger receptacle 120F is configured to receive two (and only two) additional fingers of the user's hand 18 (e.g., the index finger and middle finger). Additionally or alternatively, the handle 120 may be formed to include a portion 120P that extends outward beyond a first side edge 110E of the mount surface 110M. This extending portion 120P of the handle 120 may include one or more finger-engaging grooves 120G. In fact, in the illustrated example shown in FIG. 2D, the handle 120 includes four finger-engaging grooves 120G along its length, one for each finger. Two grooves 120G on the handle 120 are located adjacent the two finger receptacles 120F and two grooves 120G are located on the portion 120P of the handle 120 located outside the base member 110 edge 110E. In some examples of this technology, the handle 120 and its features (e.g., finger receptacle(s) 120F, finger-engaging grooves 120G, thumb-receiving chamber 120T, etc.) may be customized to fit and conform to an individual wearer's hand. Forming handles 120 (and potentially complete base members 110) using printing techniques can be beneficial for this type of customization.

FIGS. 2A, 2D, and 2E further show features of securing the base member 110 and the hand-engaging device 100 to a user's hand 18. As shown, the thumb-engaging side of the base member 110 of the hand-engaging device 100 includes a first strap connection element 140T and the opposite end of the handle 120 includes a second strap connection element 140S. A securing strap 142 extends between a free end 120X of the handle 120 (which includes strap connection element 140S in this example) to a location adjacent the thumb-receiving chamber 120T (which includes strap connection element 140T in this example). In this manner, the securing strap 142 engages and extends between the strap connection elements 140T and 140S and across the back of the wearer's hand 18, as shown in FIG. 2E. Strap connection element 140T may include an opening through which the strap 142 may extend and wrap around (e.g., to allow the strap 142 to be tightened around a user's hand 18). The securing strap 142 may include one or more securing elements 144A, 144B to hold the strap 142 in position (e.g., by wrapping the strap 144 around strap connection element 142T so securing element 144A faces and/or otherwise can engage securing element 144B). Any desired type of strap securing element(s) 144A, 144B may be provided in different examples of this technology, such as: hook-and-loop fasteners, button fasteners, snap fasteners, clasps, clamps, tied connections, etc. Additionally or alternatively, other types of securing mechanisms may be used in place of and/or along with securing strap 142, strap connection elements 140T, 140S, and/or strap securing elements 144A, 144B in other specific examples of this technology. Still additionally or alternatively, a user may engage the hand-engaging device 100 without using a strap 142 or other securing device (e.g., by grasping the handle 120).

Additionally or alternatively, in accordance with at least some examples of this technology, at least the handle 120 (and optionally other parts of the base member 110) may have one or more through hole openings or perforations 120H defined through it. See FIG. 2A. Such openings or perforations 120H, when present, can promote air flow through the handle 120, reduce sweat, wick away moisture, and help keep the user's hand cool and dry. Additionally or alternatively, such openings or perforations 120H may help reduce the weight of the base member 110.

The base member 110 may be made in any desirable manner, including through the use of molding techniques and/or from one or more component parts. In some examples of this technology, however, the base member 110 may be formed by three-dimensional printing techniques, e.g., from a nylon material, a thermoplastic elastomeric material, etc. Three-dimensional printing techniques may be well suited for forming the base member 110 with a handle 120, thumb-receiving chamber 120T, one or more finger receiving receptacles 120F, and/or one or more finger-engaging grooves 120G that are sized, shaped, configured, and optionally customized for the hand of a specific user.

FIGS. 2A-2C further show that at least one of the base member 110 and/or the traction pad 200 includes a recessed groove defined therein. In the example of FIGS. 2A-2O, the base member 110 is formed with a recessed groove 210B in its mount surface 110M. Because this example traction pad 200 is made from a generally flexible material, a recessed groove 210T is formed in the traction pad 200 when the traction pad 200 is secured to the mount surface 110M of the base member 110 (e.g., via an adhesive). Recessed groove 210T in the traction pad 200 may follow along and/or coincide with the recessed groove 210B provided in the mount surface 110M.

The recessed groove(s) 210B and/or 210T may generally extend in a direction from a forward end or edge of the base member 110 and/or the base surface 200B to a rearward end or edge of the base member 110 and/or the base surface 200B. In at least some examples of this technology, the recessed groove(s) 210B and/or 210T will extend at least 50% of a length dimension L of the base member 110 and/or the traction pad 200 measured from the forward end or edge to the rearward end or edge (e.g., see dimension L in FIGS. 2B and 2O). In some examples, the recessed groove(s) 210B and/or 210T will extend at least 60%, at least 75%, at least 80%, at least 90%, at least 95%, up to 100% of the length dimension L of the base member 110 and/or the traction pad 200. Thus, the recessed groove(s) 210B and/or 210T may terminate before reaching the rearward end or edge of the base member 110 and/or the rearward end or edge of the base surface 200B of the traction pad 200. The rearward end or edge and the forward end or edge may be located by orienting two parallel planes along and in contact with the rear and front of the base member 110 and/or traction pad 200, and the length dimension L is the distance between the two parallel planes, as generally shown in FIG. 2O.

Additionally or alternatively, most or even all of the recessed groove(s) 210B and/or 210T may be located generally within a central region of the mount surface 110M of the base member 110 and/or within a central region of the traction pad 200 with respect to the side-to-side directions of these components. The "central region" of the mount surface 110M and/or the traction pad 200 may be located by finding the rearward end or edge and forward end or edge as described above with reference again to FIG. 2O. Then a longitudinal centerline C/L of the mount surface 110M and/or traction pad 200 may be determined as the midpoint between the perimeter side edges of the mount surface 110M and/or the traction pad 200 at locations between the rearward end or edge and forward end or edge. Once the centerline C/L is located, the "central region" may be consider the 33% of the surface area of the mount surface 110M and/or the traction pad 200 centered on the longitudinal centerline C/L (the area within the dot-dash lines in FIG. 2O). In some examples of this technology, at least 50% of the surface area of the recessed groove(s) 210B and/or 210T may be located within the central region of the mount surface 110M of the base member 110 and/or within the central region of the traction pad 200, respectively. In some examples, at least 60%, at least 75%, at least 80%, at least 90%, at least 95%, up to 100% of the surface area of the recessed groove(s) 210B and/or 210T will be located within the central region(s) described above. In the illustrated examples of FIGS. 2B and 2O, the recessed groove(s) 210B and 210T have a curved shape in the forward-to-rearward direction, with the peak of the curved shape located closer to the thumb-engaging side of the base member 110 than to the finger-engaging side of the base member 110 and/or with the curve(s) of the groove(s) 210B, 210T extending away from the thumb-engaging side of the base member 110.

As further shown in FIGS. 2A and 2B, the recessed groove(s) 210B and/or 210T extend continuously in a longitudinal direction to form a forward groove portion and a rearward groove portion. A deepest part 210D of the recessed groove(s) 210B and/or 210T of these examples is located closer to the forward end of the base member 110 and/or traction pad 200 than to the rearward end of the base member 110 and/or traction pad 200. In some examples of this technology, the recessed groove(s) 210B and/or 210T will become continuously shallower in a rearward direction from the deepest part 210D.

Additional features of traction pads 200 and the plurality of traction elements 250 included with them now will be described with reference to the example structures shown in FIGS. 2F-2O. As shown in these figures, the traction pad 200 includes a base surface 200B (which may be made from one or more layers) and the plurality of traction elements 250 extend away from this base surface 200B to their free ends 250E. The base surface 200B of the traction pad 200 illustrated in FIGS. 2F-2O includes a multi-layered structure. While other structures are possible, in this illustrated example, the bottom side of the traction pad 200's base surface 200B includes a fabric material component 240F (e.g., one or more layers of a cotton fabric material, woven material, non-woven material, knit material, etc.). The fabric material component 240F may be between 0.5 mm and 2.5 mm thick, and in some examples, from 0.6 mm to 2 mm or even from 0.75 mm to 1.5 mm thick. This bottom side of the traction pad 200's base surface 200B may be fixed with the mount surface 110M of the base member 110, e.g., by an adhesive. The top (and/or exposed) side of the traction pad 200 includes a rubber material 240R (e.g., a rubber coating or layer). This rubber material 240R may be between 0.75 mm and 5 mm thick, and in some examples, from 1 mm to 3.5 mm or even from 1.25 mm to 2.5 mm thick. In some examples of this technology, the overall base surface 200B may be from about 1.5 mm thick to 7.5 mm thick, although other ranges are possible in other specific examples of this technology. As evident from FIGS. 2F and 2H-2O, in these examples where base surface 200B of the traction pad 200 has a multi-layered structure (e.g., including fabric material component 240F layer and rubber material 240R layer), the plurality of traction elements 250 extend outward from an exposed surface of the layer of rubber material 240R.

The rubber material 240R layer(s) and/or fabric material component 240F layer(s) may be provided so that the pushrim 20 engaging surface of the traction pad 200 has some resiliency when contacting the pushrim 20 in use. This resiliency (e.g., compressibility) may help increase the number of traction elements 250 that will engage (and thus "grip") the pushrim 20 when the traction pad 200 contacts the pushrim 20 (e.g., at least at the initial "pushing point" position A and/or throughout the push cycle show in FIG. 1D). As a more specific example, the resiliency or compressibility may help the traction pad 200 better wrap around and/or conform to the shape of the pushrim 20 when force is applied during use. These features also may help reduce the impact force against the user's hand 18 during use and/or provide return energy to the wearer's hand.

FIG. 2C shows an additional or alternative feature that may be included in hand-engaging devices 100 in accordance with at least some aspects of this technology. In addition to or as an alternative to the recesses 112 shown in FIG. 2C, that general area of the base member 110 may be formed to have a recess configured to receive a fluid-filled bladder 170 (with the bladder 170 positioning generally shown by arrows 170A in FIG. 2C). In the example shown in FIG. 2C, the fluid-filled bladder 170 is located at the second side 110B of the base member 110 such that, in the final assembled hand-engaging device 100, the fluid-filled bladder 170 will be located between the base surface 200B of the traction pad 200 and the second side 110B of the base member 110. The fluid-filled bladder 170 may overlie the handle 120 of the base member 110. The fluid-filled bladder 170 may have structures that are the same as or similar to bladders used in footwear products commercially available from NIKE, Inc. of Beaverton, Oregon.

The fluid-filled bladder 170 may at least partially fit into (e.g., nest into) a recess formed in the second side 110B of the base member 110 (e.g., a recess formed in the mount surface 110M of the base member 110's second side 110B). If desired, the sidewalls of the recess may be sized and shaped to generally correspond to the size and shape of an outer perimeter of the fluid-filled bladder 170. In such structures, the sidewalls of the recess may help limit or reduce outward extension or expansion of the fluid-filled bladder 170 under an applied force, thereby maintaining the fluid-filled bladder 170 and the fluid contained therein in position to engage the pushrim 20 and protect the user's hand. Such structures (along with the pressure level in the fluid-filled bladder 170) also may help to avoid the applied force from "bottoming out" in the fluid-filled bladder 170. Thus, in at least some examples of this technology, the fluid-filled bladder 170 may define a surface area smaller than the surface area of one or more of the mount surface 110M, the second side 110B of the base member 110, and/or the traction pad 200.

The fluid-filled bladder 170 may be engaged with the base member 110 in any desired manner, such as by one or more of: adhesives, welding techniques (e.g., welding or tacking the bladder 170 to a thermoplastic polyurethane material forming the base member 110), one or more mechanical fasteners, one or more interlocking features, a friction fit, etc. The fluid-filled bladder 170 may be positioned to correspond to and bridge the location of the recessed groove(s) 210B of the base member 110 and/or to underlie and bridge the location of the recessed groove 210T of the traction pad 200 (e.g., when such grooves 210B and/or 210T are present). In some examples, the fluid-filled bladder 170 may be shaped to include a groove (e.g., a central groove (like groove 170G shown in FIG. 2C)) that nests and/or aligns with grooves 210B and/or 210T.

In some examples at this technology, the fluid-filled bladder 170 may be covered by a cover member, like cover plate 114, or it may be directly covered by (and in contact with) the traction pad 200. The fluid-filled bladder 170, when present, may enhance the resiliency and/or impact force attenuation features described above. Additionally or alternatively, the fluid-filled bladder 170 may deform under applied force to better conform to the shape of the pushrim 20 and/or to help increase the number of traction elements 250 that will engage (and thus "grip") the pushrim 20 when the traction pad 200 contacts the pushrim 20 and/or throughout the push cycle show in FIG. 1D. Still additionally or alternatively, the fluid-filled bladder 170 may reduce the impact force incident against the user's hand 18 on the handle 120 during use. Additionally or alternatively, the fluid-filled bladder 170 may provide return energy to the wearer's hand as the push force against the pushrim 20 is relaxed. In any of these manners, the fluid-filled bladder 170 may help reduce hand fatigue. The fluid pressure in the fluid-filled bladder 170 may be selected to provide and/or enhance one or more of these features.

Also, while the discussion above relates to hand-engaging device 100 examples having a single fluid-filled bladder 170, two or more bladders could be provided in other specific examples of this technology. As a more specific example, multiple bladders could be provided along the direction of the grooves 210B and/or 210T, e.g., with one bladder oriented toward the forward end or edge of the base member 110 and/or traction pad 200 and a second, separate bladder oriented toward the rearward end or edge of the base member 110 and/or traction pad 200. When two or more bladders are present, they may have the same or different characteristics, e.g., the same or different sizes, shapes, fluid pressures, etc.

Figure 2H:
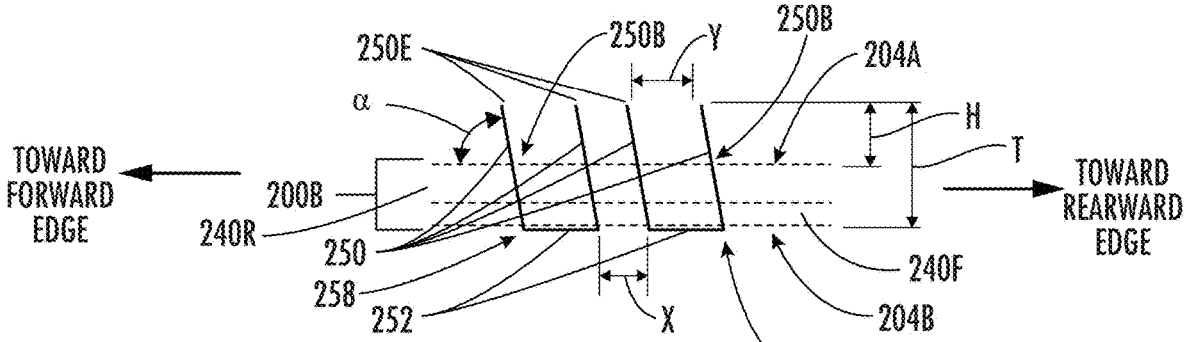

The traction elements 250 of a "first set" include a cylindrical structure extending from the base surface 200B of the traction pad 200 to the free end 250E of that respective traction element 250. As shown in FIG. 2H, the first set of the plurality of traction elements 250 will have their free ends 250E spaced apart from an exposed exterior face at the first side 204A of the base surface 200B, e.g., by dimension H shown in FIG. 2H. Dimension H (which corresponds to an exposed height dimension of the traction elements 250 of this first set) may be within a range of 0.5 mm to 4 mm, and in some examples, from 0.75 mm to 3 mm, or from 1 mm to 2.5 mm. Additionally or alternatively, the traction elements 250 of this first set may have a circular transverse cross-section with a diameter in a range of 0.2 mm to 1.5 mm (and in some examples, less than 1 mm or even less than 0.75 mm in diameter), and/or a non-circular transverse cross-sectional shape with a largest diagonal dimension within in a range of 0.2 mm to 1.5 mm (and in some examples, less than 1 mm or even less than 0.75 mm in largest diagonal dimension).

The plurality of traction elements 250 may be made from a metal material, such as steel, hardened steel, aluminum, etc., a hard plastic material, a ceramic material, etc. In some examples, when made from metals, the traction elements 250 may be treated to have anti-rust properties (e.g., zinc coated).

At least some of the plurality of traction elements 250 in a traction pad 200 may comprise "one-way" traction elements, i.e., traction elements that resist relative movement (e.g., sliding movement against a friction force) with respect to a contact surface when force (a sliding force) is applied in a first direction but permit relative movement with respect to the contact surface when the force is applied in at least one other direction (e.g., the opposite direction). In at least some examples of this technology, a force required to cause relative movement (e.g., sliding movement) between the two contacting surfaces (e.g., between the traction pad 200 and the pushrim 20) in the first direction will be at least 5 times greater than a force required to cause relative movement (e.g., sliding movement) between the two contacting surfaces (e.g., between the traction pad 200 and the pushrim 20) in another direction (e.g., in the opposite direction), and in some examples, at least 10 times greater, at least 15 times greater, or even at least 20 times greater (with the required forces measured under the same test conditions).

Various ways of creating this "one-way" traction feature may be used in aspects of this technology. For example, at least some of the plurality of traction elements 250 (e.g., traction elements in a "first set") may extend away from the base surface 200B in a forward direction with respect to the hand-engaging device 100 such that the free ends 250E of the traction elements 250 of this first set are located further forward than are a corresponding base region 250B of that traction element 250. As shown in FIG. 2H, the base region 250B of a traction element 250 corresponds to a location where an exposed portion of the traction element 250 begins extending away from the base surface 200B of the traction pad 200 (e.g., at the first side 204A of the base surface 200B). The traction elements 250 of this first set may be arranged such that, with the base surface 200B of the traction pad 200 oriented flat on a horizontal support surface (e.g., as shown in FIG. 2H), at least some of the plurality of traction elements 250 of the first set are oriented in a forward angled direction toward a forward edge of the hand-engaging device 100. In some examples, this forward angle $\alpha$ may be between 1 degree to 15 degrees with respect to a vertical direction, and in some examples, at an angle is between 2.5 degrees and 14 degrees, or at an angle between 5 degrees and 12 degrees with respect to the vertical direction. This forward tilt of the traction elements 250 and/or the fact that the free ends 250E are spaced apart from the base surface 200B allow the relatively sharp free ends 250E to engage the pushrim 20 (e.g., its rubber or elastomeric outer layer) when pushed in the forward direction into the pushrim 20 (e.g., allowing the free ends 250E to potential dig into the rubber or elastomeric material of the pushrim 20), but allows the free ends 250E to slide relatively freely with respect to the pushrim 20 when moved in the rearward (opposite) direction.

Any number, portion, or proportion of the traction elements 250 may have forward tilt features of the types described above and/or may be contained in the "first set" of traction elements 250. As some more specific examples, the traction elements 250 having forward tilt features of the types described above and/or contained in the "first set" of traction elements 250 may comprise at least 50% of a total number of the traction elements extending from the base surface 200B, and in some examples, at least 60%, at least 75%, at least 90%, at least 95%, or even up to 100% of a total number of the traction elements 250 extending from the base surface 200B. As some absolute numbers, the number of traction elements 250 having forward tilt features of the types described above and/or contained in the "first set" of traction elements 250 in a traction pad 200 according to examples of this technology may comprise at least 100 spaced apart free ends 250E, and in some examples, at least 150 spaced part free ends 250E, at least 200 spaced apart free ends 250, at least 250 spaced apart free ends 250, at least 300 spaced apart free ends 250, at least 400 spaced apart free ends 250, or even at least 500 spaced apart free ends 250.

In some examples of this technology, the free ends 250E of at least some of the traction elements 250 may be spaced apart from the free end 250E of a nearest adjacent traction element 250 within a range of 1.5 mm to 5 mm, and in some examples, within a range from 1.75 mm to 4.5 mm or even within a range from 2 mm to 4 mm. As some additional examples, at least 25% of the traction elements 250 of the traction pad 200 may include free end 250E spacings within these ranges. At least 40%, at least 50%, at least 60%, at least 75%, at least 80%, at least 90%, at least 95%, or even up to 100% of the traction elements 250 may have free end 250E spacings within any of these ranges. But, not all of the free ends 250E in a traction pad 200 need have the same spacing distances from the free ends 250E of their adjacent traction elements 250. Additionally or alternatively, not all traction elements 250 in a traction pad 200 need have the same size, shape, length, and/or other dimensional features (although at least 25%, at least 40%, at least 50%, at least 60%, at least 75%, at least 80%, at least 90%, at least 95%, or even up to 100% of the traction elements 250 may have the same size, shape, length, and/or other dimensional features).

Additionally or alternatively, in some examples of this technology, the plurality of traction elements 250 may be arranged on the traction pad 200 to have an average packing density of at least 5 traction elements 250 per square centimeter over an area of the base surface 200B of at least 25 $cm^2$. In some examples, the average packing density may comprise at least 8 traction elements 250 per square centimeter, at least 10 traction elements 250 per square centimeter, or at least 12 traction elements 250 per square centimeter, or even at least 15 traction elements 250 per square centimeter over an area of the base surface 200B of at least 25 $cm^2$. Any of these average packing density ranges may be present over a larger portion of the base surface 200B, including over at least 40 $cm^2$, at least 50 $cm^2$, or even at least 75 $cm^2$.

FIGS. 2F-2O further show that at least some of the plurality of traction elements 250 of a traction pad 200 may include multiple traction elements 250 formed as a unitary, one-piece structure (e.g., with two (or more) traction elements 250 connected by a common traction element base). A unitary, one-piece structure having multiple traction elements 250 (e.g., extending from a common traction element base 252) also is referred to herein as a "traction element component 258." For example, FIGS. 2G-2J show that traction element components 258 have at least some of their plurality of traction elements 250 (e.g., a "first set" of traction elements 250) extending away from and spaced apart from the base surface 200B at a first side 204A of the base surface 200B. At least some of these traction element components 258 having two (or more) traction elements 250 connected as a unitary, one-piece structure may include: (a) a traction element base 252 extending along a portion of a second side 204B of the base surface 200B located opposite the first side 204A of the base surface 200B, (b) a first traction element 250 extending away from the traction element base 252 and through the base surface 200B from the second side 204B of the base surface 200B to the first side 204A of the base surface 200B and to a first free end 250E of the first traction element 250 that is spaced apart from the first side 204A of the base surface 200B, and (c) a second traction element 250 extending away from the traction element base 252 and through the base surface 200B from the second side 204B of the base surface 200B to the first side 204A of the base surface 200B and to a second free end 250E of the second traction element 250 that is spaced apart from the first side 204A of the base surface 200B. These example "one-piece" unitary structures forming traction element components 258 having two traction elements 250 may have a shape akin to the shape of a staple. The first traction element 250 and the second traction element 250 of the unitary structure(s) of the traction element components 258 may extend in parallel to one another (although this is not a requirement in all examples of this technology).

In some examples of this technology, a "first set" of the traction element components 258 having this type of unitary, one-piece structure (e.g., with two (or more) traction elements 250 joined to a single traction element base 252) may include at least 50 traction element components 258 having the unitary, one-piece structure, and in some examples, at least 100 traction element components 258 having the unitary, one-piece structure, at least 150 traction element components 258 having the unitary, one-piece structure, at least 200 traction element components 258 having the unitary, one-piece structure, at least 250 traction element components 258 having the unitary, one-piece structure, or even at least 300 traction element components 258 having the unitary, one-piece structure.

Figure 2I:
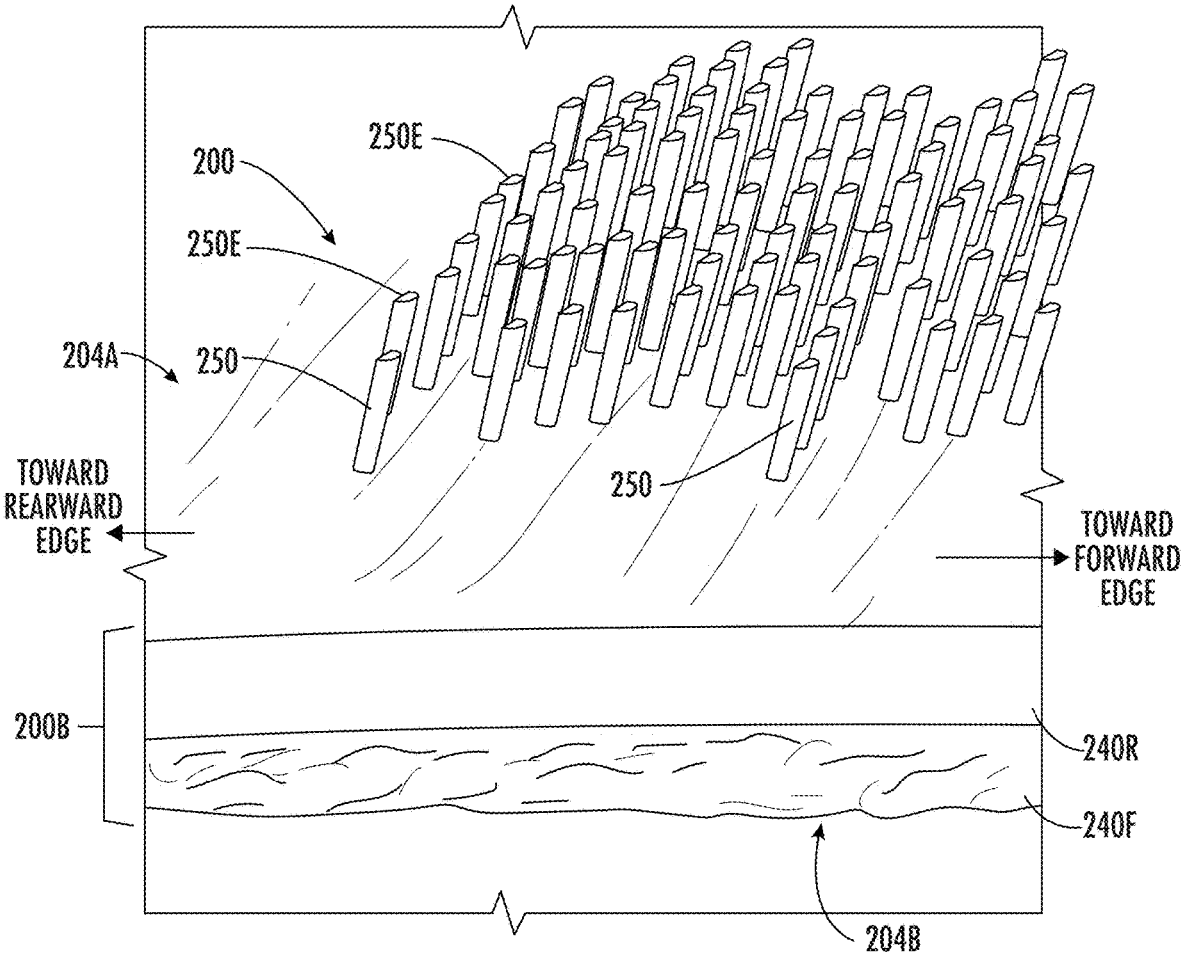

In at least some examples of this technology, the traction elements 250 formed as traction element components 258 having the unitary structure may be arranged in the traction pad 200 such that the traction element bases 252 of the traction element components 258 are arranged in one or more rows at the second side 204B of the base surface 200B. Note, for example, FIGS. 2G and 2L (FIG. 2L shows the traction pad 200 curved into a cylinder shape so that the rubber material 240R is located at the outside of the cylinder and the fabric material 240F is located inside the cylinder, e.g., to illustrate the flexibility of the traction pad 200). In the illustrated examples, the traction element components 258 are arranged such that their traction element bases 252 are located in plural rows (optionally curved rows) at the second side 204B of the base surface 200B.

Figure 2J:
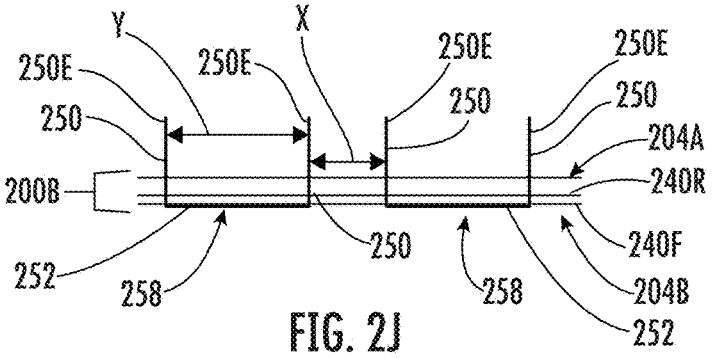
Figure 2K:
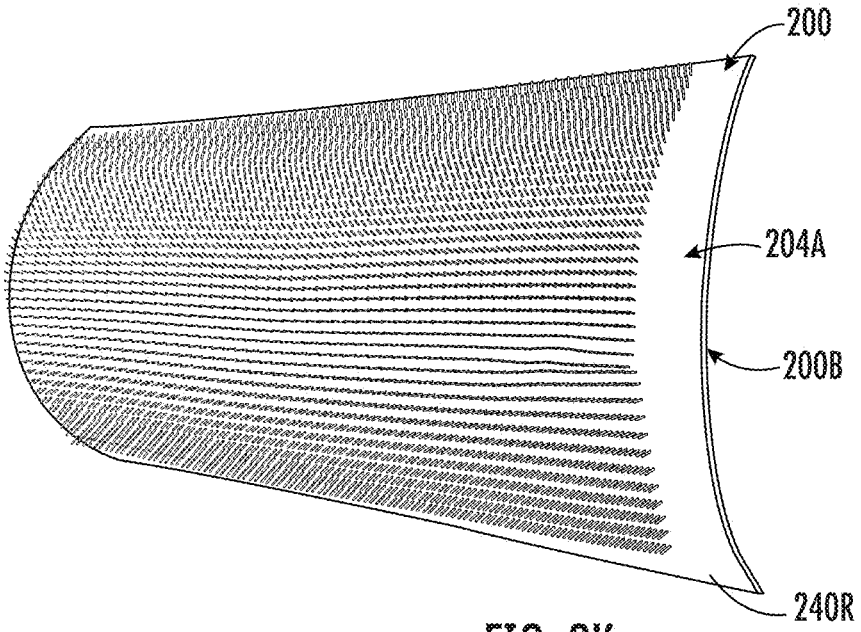
Figure 2L:
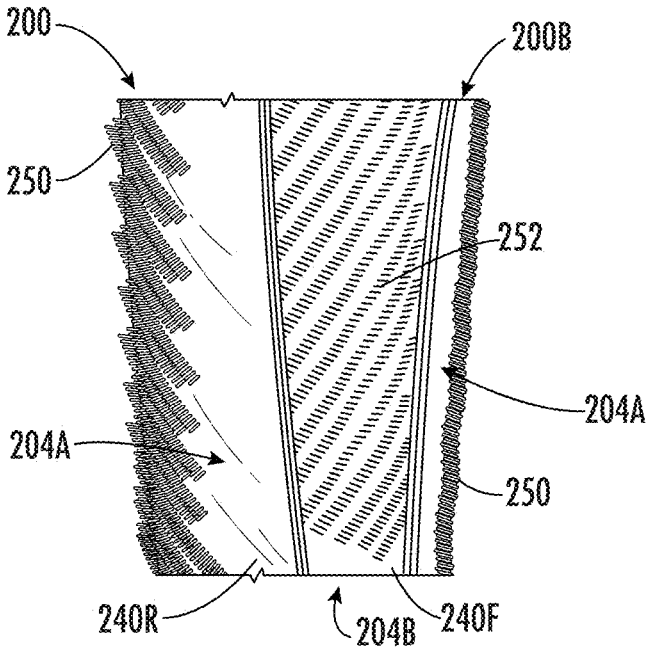
Figure 2M:
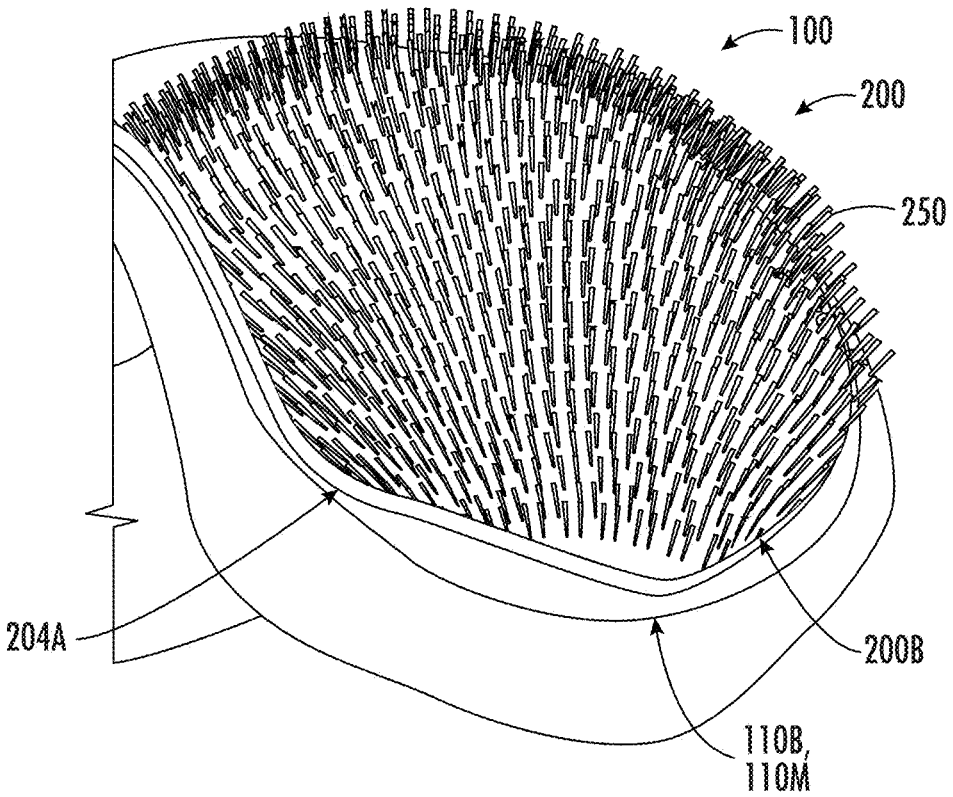
Figure 2N:
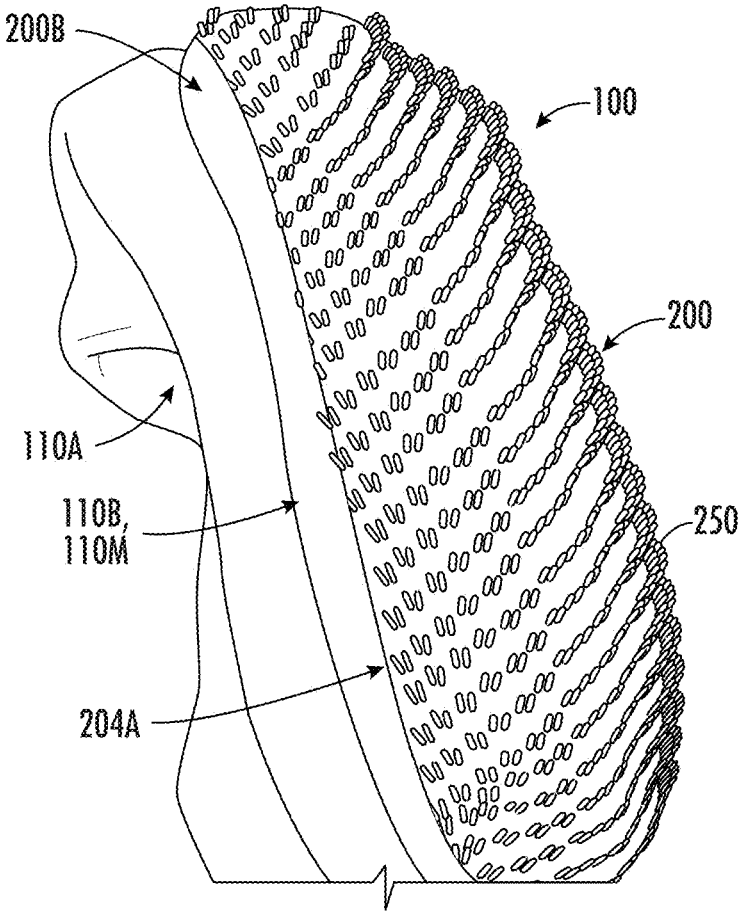
Figure 20:
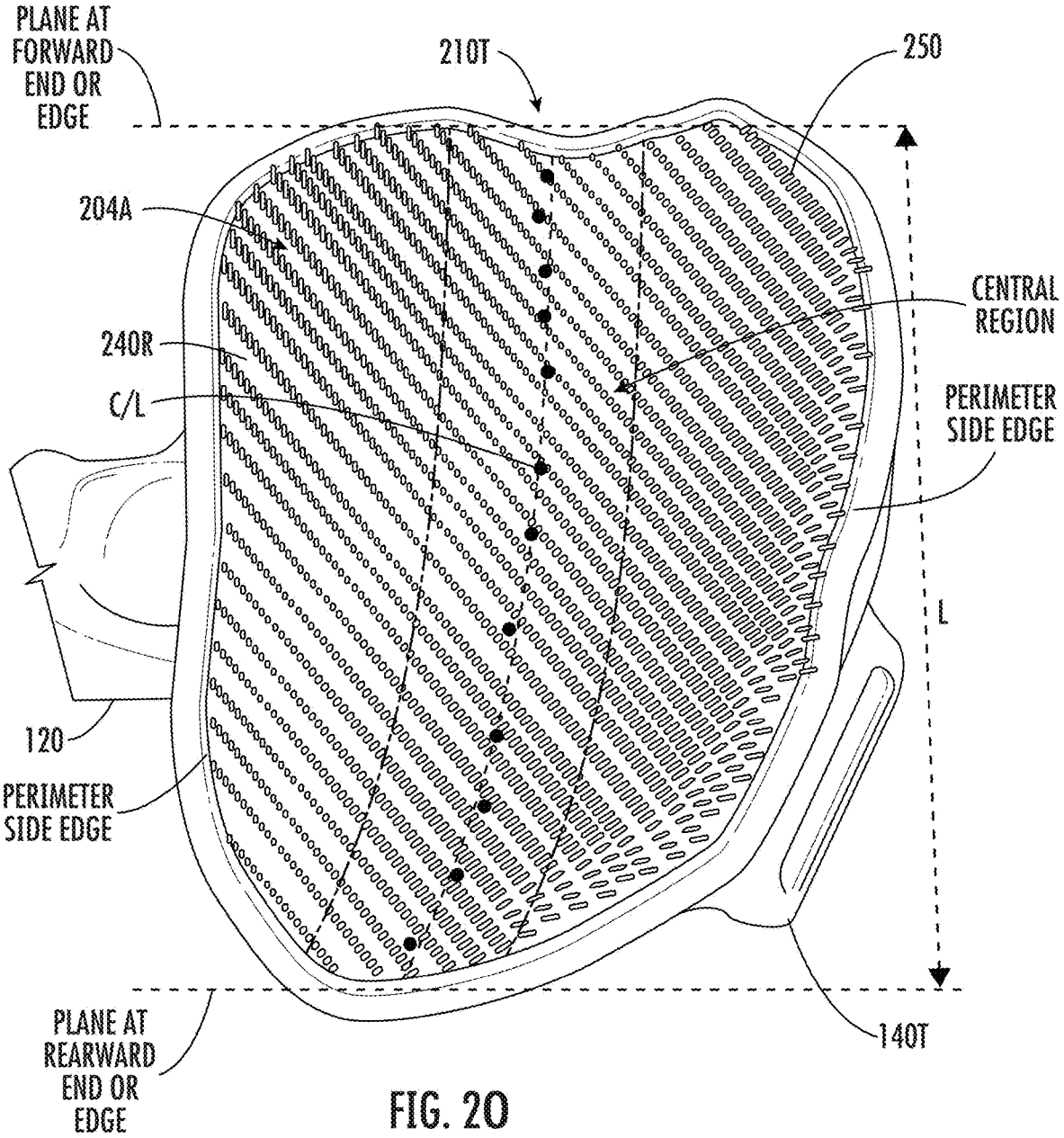

As some additional potential features, as shown in FIGS. 2H and 2J, one row of traction element components 258 having the unitary structure may be separated from an adjacent row of traction element components 258 having the unitary structure by a spacing X in a range of 1.5 mm to 5 mm (and in some examples, within a spacing X range from 1.75 mm to 4.5 mm or even within a range from 2 mm to 4 mm). Additionally or alternatively, the spacing Y between a first traction element 250 of a traction element component 258 having the unitary structure and a second traction element 250 of that same traction element component 258 (e.g., at their free ends 250E and/or along at least a portion of their lengths) may be in a range of 1.5 mm to 5 mm (and in some examples, within a spacing Y range from 1.75 mm to 4.5 mm or even within a range from 2 mm to 4 mm). Spacing X may be the same as or different from spacing Y. In some specific examples, spacing Y may be greater than spacing X, e.g., with spacing Y 1.2 to 1.5 times greater than spacing X. Still additionally or alternatively, within a single row of the traction element components 258 having the unitary structure, a traction element base 252 of one traction element component 258 in the single row may be separated from a traction element base 252 of an immediately adjacent traction element component 258 within the single row by a spacing of less than 3 mm (and in some examples, by a spacing of less than 2 mm, or even a spacing less than 1.5 mm). The traction elements 250 of traction element components 258 may have exposed height dimensions H within any of the ranges for dimension H described above (plus additional sufficient height to extend from the traction element base 252 through the base surface 200B materials, e.g., of the types described above). In total, the traction elements 250 of traction element components 258 may have a total height dimension T from the traction element base 252 to the free end 250E within a range from 1.75 mm to 11.5 mm (and in some examples, within a range from 2.5 mm to 10 mm, or from 3 mm to 6 mm).

In some examples of this technology, in a traction pad 200 structure, the portion or proportion of traction elements 250 having the unitary structure and formed as traction element components 258 (e.g., a "first set" of the plurality of traction elements 250) will include at least 25% of the total number of traction elements 250 extending from the base surface 200B, and in some examples, at least 40%, at least 50%, at least 60%, at least 75%, at least 80%, at least 90%, at least 95%, or even up to 100% of the total number of the traction elements 250 extending from the base surface 200B and/or included in the traction pad 200. As some absolute numbers, the number of traction element components 258 having the unitary structure (e.g., a "first set" of the plurality of traction elements 250) in a single traction pad 200 may include at least 50 traction element components 258, at least 100 traction element components 258, at least 150 traction element components 258, at least 200 traction element components 258, or even at least 250 traction element components 258.

As shown in FIGS. 2H and 2I, at least some of the traction element components 258 having the unitary structures (e.g., in a "first set" of traction element components 258 having the unitary structure) may have "one-way" traction features, e.g., of the types described above. For example, at least some of the traction element components 258 having the unitary structures may have their traction elements 250 extending away from the base surface 200B in a forward direction with respect to the hand-engaging device 100. In this manner, the free ends 250E of the traction elements 250 of the traction element components 258 will be located further forward than are a corresponding traction element base 252 of that traction element component 258. As some more specific examples, in the traction element component 258 structure, with the base surface 200B of the traction pad 200 oriented flat on a horizontal support surface (e.g., as shown in FIG. 2H), the first traction element 250 and the second traction element 250 of the traction element components 258 may be oriented at an angle α of 1 degree to 15 degrees with respect to a vertical direction (and in some examples, this angle α may be between 2.5 degrees and 14 degrees or between 5 degrees and 12 degrees with respect to the vertical direction). At least 25% of a total number of traction elements 250 extending from the base surface 200B and/or at least 25% of a total number of traction element components 258 having the unitary structure may have forward angular features within the ranges described above. In some examples, at least 40%, at least 50%, at least 60%, at least 75%, at least 80%, at least 90%, at least 95%, or even up to 100% of the total number of the traction elements 250 extending from the base surface 200B and/or included in the traction pad 200 may be formed as traction element components 258 having a unitary structure and with any of these angular features. As some absolute numbers, the number of traction element components 258 having the unitary structure and any one or more of these forward angled features in a single traction pad 200 may include at least 50 traction element components 258, at least 100 traction element components 258, at least 150 traction element components 258, at least 200 traction element components 258, or even at least 250 traction element components 258 having the unitary structure.

The individual traction elements 250 (either in a unitary structure of a traction element component 258 or individually) in a traction pad 200 may have various different shapes. In some examples, the traction elements 250 (either in a unitary structure of a traction element component 258 or present individually) may include a cylindrical structure extending from the base surface 200B of the traction pad 200 to the free end 250E thereof. Such cylindrical structures may have a circular cross-section with a diameter in a range of 0.2 mm to 1.5 mm (and in some examples, within a range of 0.25 mm to 1 mm or within a range from 0.3 mm to 0.75 mm). When not present with a circular cross-section (e.g., a polygonal cross-section or other cross-sectional shape), the cylindrical structures may have a largest diagonal dimension within a range of 0.2 mm to 1.5 mm (and in some examples, within a range of 0.25 mm to 1 mm or within a range from 0.3 mm to 0.75 mm).

Additionally or alternatively, in some examples of this technology, the plurality of traction element components 258 having the unitary structure may be arranged on the traction pad 200 to have an average packing density of at least 2 traction element components 258 having a unitary structure per square centimeter over an area of the base surface 200B of at least 25 $cm^2$. In some examples, the average packing density may comprise at least 4 traction element components 258 having a unitary structure per square centimeter, at least 5 traction element components 258 having a unitary structure per square centimeter, at least 6 traction element components 258 having a unitary structure per square centimeter, or even at least 8 traction element components 258 having a unitary structure per square centimeter over an area of the base surface 200B of at least 25 $cm^2$. Any of these average packing density ranges may be present over a larger portion of the base surface 200B, including over at least 40 $cm^2$, at least 50 $cm^2$, or even at least 75 $cm^2$.

In at least some examples of this technology, a first traction element 250 extending from the traction element base 252 may have common size and/or shape features with a second traction element 250 extending from that same traction element base 252. In other examples, however, the sizes and/or shapes of the traction elements 250 extending from a single traction element base 252 may differ from one another. Additionally or alternatively, a first traction element component 258 having the unitary structure (including plural traction elements 250 extending from a common traction element base 252) may have the same size, shape, and/or other characteristics of one or more other traction element components 258 having a unitary structure of the traction pad 200. As some more specific examples, at least 25% of a total number of traction element components 258 having unitary structures in a traction pad 200 may have common structures (and in some examples, at least 40%, at least 50%, at least 60%, at least 75%, at least 80%, at least 90%, at least 95%, or even up to 100% of the traction element components 258 having the unitary structure present in the traction pad 200 may have common structures).

Figure 3A:
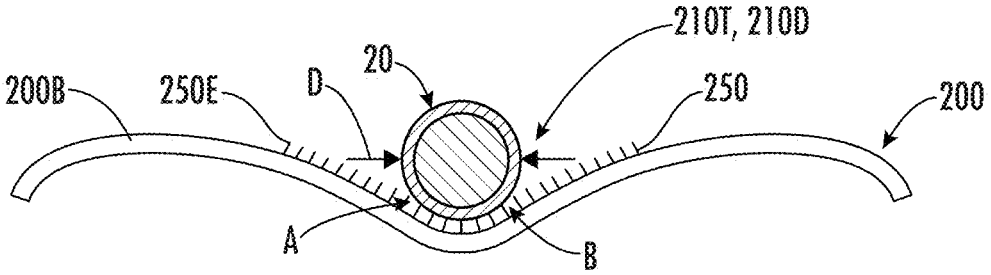
FIGS. 3A and 3B illustrate features of engagement of a pushrim within a recessed groove in hand-engaging devices in accordance with at least some examples of this technology.
Figure 3B:
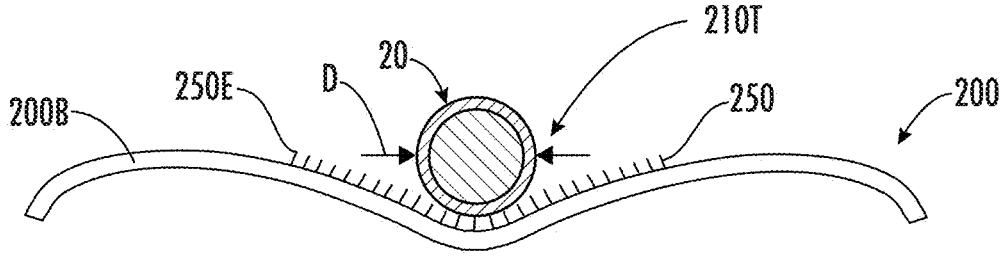

FIGS. 3A and 3B schematically show a traction pad 200 having its groove 210T engaging a pushrim 20 (e.g., of a wheel 12R, 12L). FIG. 3A shows a view with the pushrim 20 in the deepest part 210D of the groove 210T and FIG. 3B shows a view with the pushrim 20 in a shallower portion of the groove 210T (e.g., located rearward from the deepest part 210D). As shown in these figures, plural traction elements 250 are located within the recessed groove 210T, including within the deepest part 210D of the recessed groove 210T. In the deepest part 210D of the recessed groove 210T, the traction elements 250 are sized, shaped, and arranged so that their free ends 250E or edges contact the outer rim or tube of the pushrim 20 (e.g., having a cross-sectional diameter or diagonal D of from 6 mm to 25 mm) over a distance spanning at least one eighth of a circumference of the pushrim 20's rim or tube (from Points A to B in FIG. 3A). In some examples, the traction elements 250 may be sized, shaped, and arranged so that their free ends 250E contact the outer rim or tube of the pushrim 20 over a distance spanning at least one seventh, one sixth, one fifth, or even one fourth of a circumference of the pushrim 20's rim or tube. As described above, some resilience and/or compressibility of the base surface 200B (e.g., provided by rubber material 240R and/or fabric material component 240F of the base surface 200B) and/or provided by a fluid-filled bladder 170 (if present) can help further seat the pushrim 20 into the recessed groove 210T and provide engagement with more traction elements 250 and/or around a greater proportion of the pushrim 20's circumference.

Several traction elements 250 may be provided within recessed groove 210T and available to engage a pushrim 20. In some examples of this technology, at least 50 of the plurality of traction elements 250 will be at least partially located within recessed groove 210T and have their free ends 250E exposed within the recessed groove 210T. Additionally or alternatively, at least 100, at least 150, at least 200, or even at least 250, traction elements 250 and free ends 250E thereof may be located within and exposed in the recessed groove 210T. When present as traction element components 258 with multiple traction elements 250 extending from a single traction element base 252 of the types described above, at least some of the traction element components 258 (e.g., a "first set" of the traction element components 258 formed as unitary structures) may be located within and have their free ends 250E exposed within the recessed groove 210T. As some more specific examples, at least 25 traction element components 258 having unitary structures, at least 50 traction element components 258 having unitary structures, at least 75 traction element components 258 having unitary structures, at least 100 traction element components 258 having unitary structures, or even at least 125 traction element components 258 having unitary structures may have their traction elements 250 and free ends 250E located within and exposed the recessed groove 210T.

Figure 4:
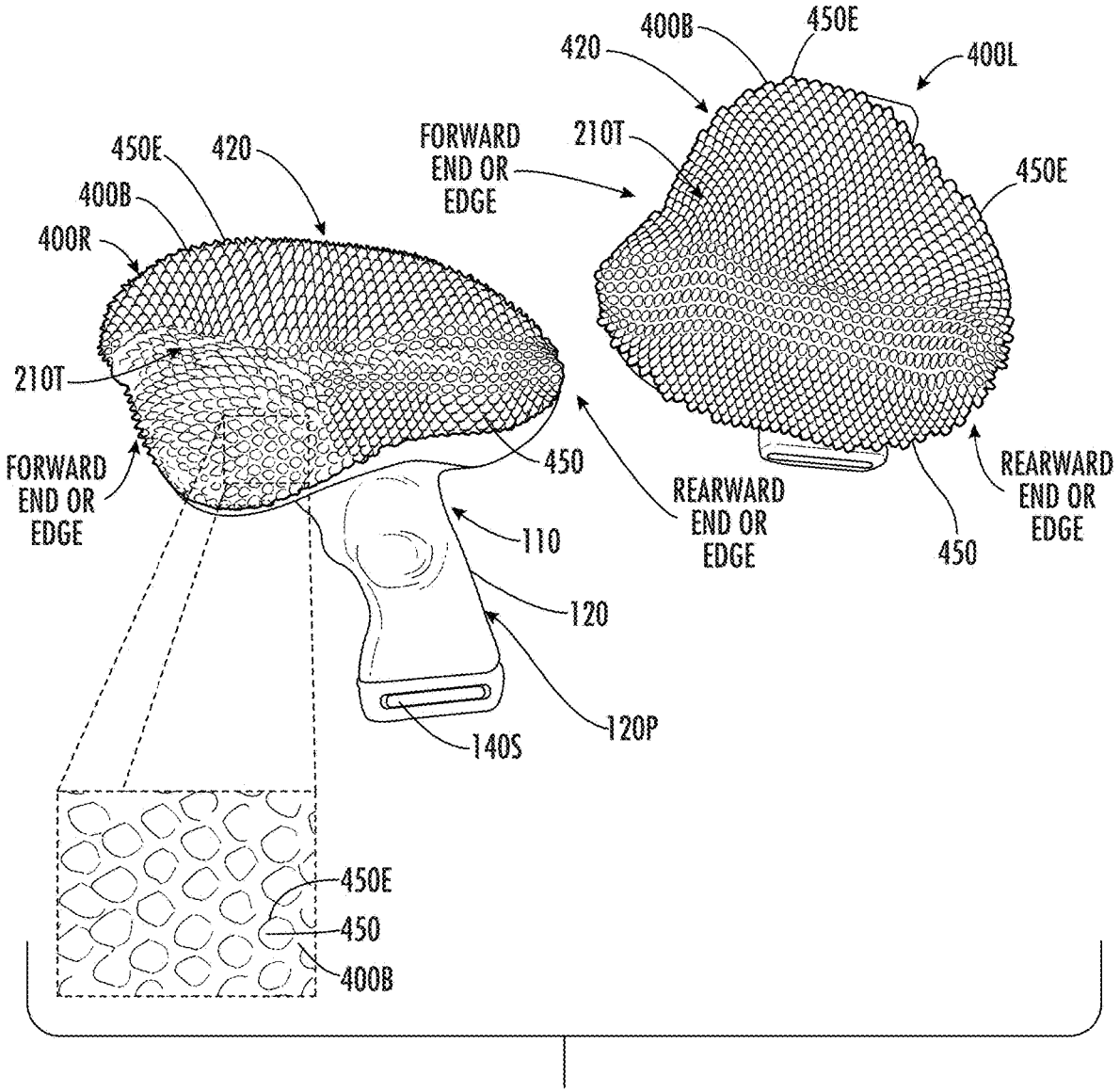
FIG. 4 illustrates another example of hand-engaging devices in accordance with at least some examples of this technology.

FIG. 4 shows a pair of hand-engaging devices 400L and 400R in accordance with other examples of this technology. These hand-engaging devices 400L and 400R are for opposite hands and may be mirror images of one another. Where the same reference numbers are used in FIG. 4 as are used in any of FIGS. 2A-3B described above, the same or similar parts are being referenced, and much of the overlapping description may be omitted. The discussion below will focus on at least some features of the hand-engaging devices 400L and 400R that differ from the hand-engaging devices 100 described above in conjunction with FIGS. 2A-3B.

The base member 110 of the hand-engaging devices 400L, 400R of FIG. 4 may have any of the features of base members 110 described above in conjunction with FIGS. 2A-3B (including any options or alternatives for the base members 110 described above).

In the example of FIG. 4, the traction pads 420 differ from the traction pads 200 described above in conjunction with FIGS. 2A-3B. In the example of FIG. 4, the traction elements 450 are integrally formed with the base surface 400B of the traction pad 420. The traction pads 420 with integrally formed traction elements 450 may be formed, for example, by molding techniques, by three-dimensional printing techniques, or in another suitable manner. The traction pads 420 may be formed from rubber, nylon, thermoplastic polyurethanes, other thermoplastic materials, thermosetting materials, metals, or other desired materials. While the traction pad 420 may be made as a separate part from the base member 110 (and engaged with the base member 110 in any of the manners described above), the traction pad 420 may be integrally formed with at least some part of the base member 110 (e.g., by three dimensional printing techniques) in other examples of this technology.

The traction elements 450 of the traction pads 420 of FIG. 4 also have more of "spike" structure, e.g., with somewhat of a pyramidal or conical shape extending outward from the base surface 400B to the free ends 450E. The pyramidal or conical shapes may have a circular or polygonal transverse cross-section (with the cross-sectional plane located between the base surface 400B and free end 450E). The traction elements 450 may have any of the forward angular features and/or one-way traction features of the traction elements 250 described above in conjunction with FIGS. 2A-3B (including angles $\alpha$ within the ranges described above). Additionally or alternatively, the traction elements 450 may have any of the dimensional, sizing, and/or spacing features within any of the ranges described above for traction elements 250.

Figure 5A:
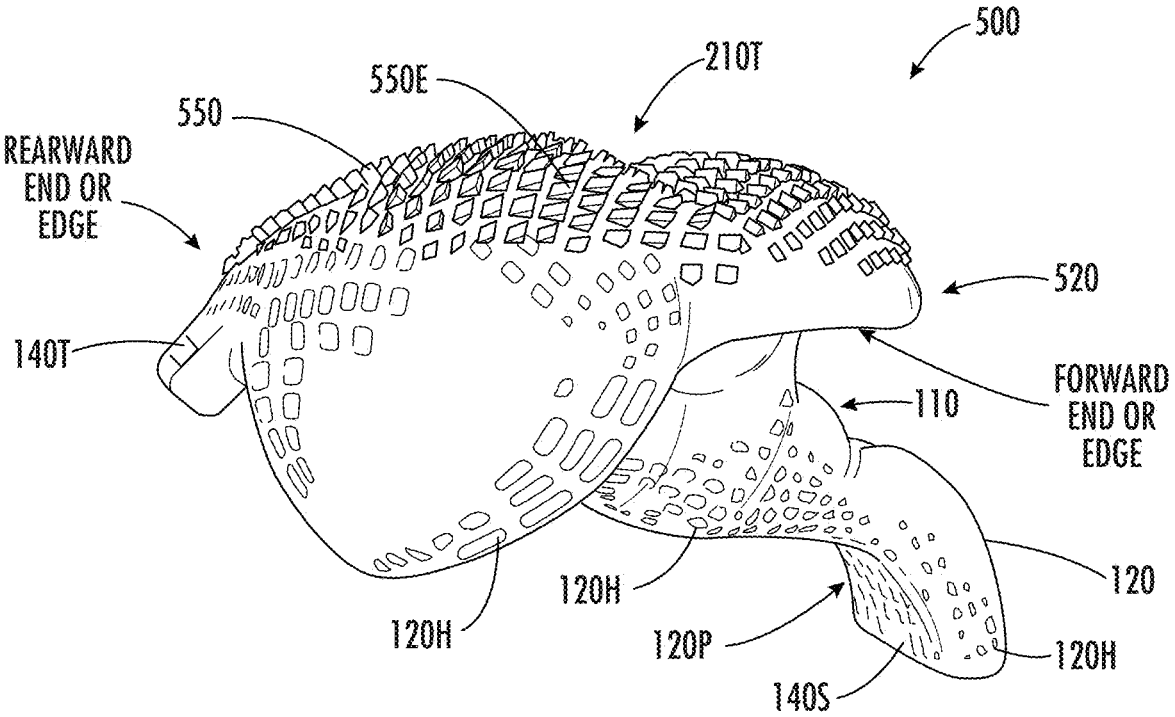
FIGS. 5A and 5B illustrate another example of a hand-engaging device in accordance with some examples of this technology.
Figure 5B:
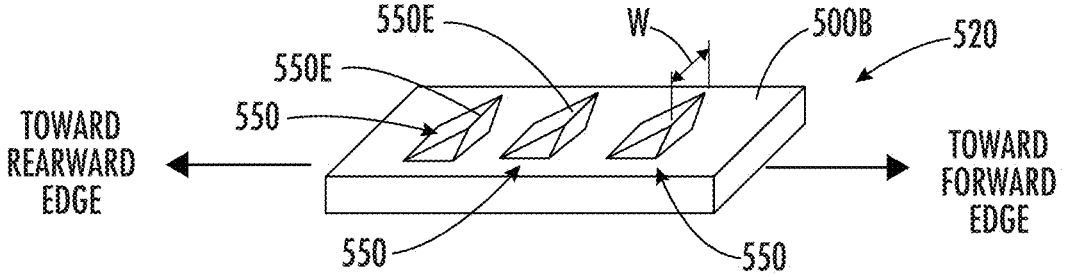

FIGS. 5A and 5B illustrate another example hand-engaging device 500 in accordance with some aspects of this technology. Where the same reference numbers are used in FIGS. 5A and 5B as are used in any of FIGS. 2A-4 described above, the same or similar parts are being referenced, and much of the overlapping description may be omitted. The discussion below will focus on at least some features of the hand-engaging device 500 that differ from the hand-engaging devices 100, 400R, 400L described above in conjunction with FIGS. 2A-4.

The base member 110 of the hand-engaging device 500 of FIG. 5A may have any of the features of base members 110 described above in conjunction with FIGS. 2A-4 (including any options or alternatives for the base members 110 described above).

In the example of FIGS. 5A and 5B, the traction pad 520 differs from the traction pads 200, 420 described above in conjunction with FIGS. 2A-4. In the example of FIGS. 5A and 5B, the traction elements 550 are integrally formed with the base surface 500B of the traction pad 520 and are shaped to have a more elongated free edge 550E. The free edges 550E may be straight (e.g., as shown in FIGS. 5A and 5B) and/or curved (e.g., somewhat like a fish scale). The traction elements 550 may have any of the forward angular features and/or one-way traction features of the traction elements 250 described above in conjunction with FIGS. 2A-3B (including angles $\alpha$ within the ranges described above). Additionally or alternatively, the traction elements 550 may have any of the dimensional, sizing, and/or spacing features within any of the ranges described above for traction elements 250. The elongated free edges 550E of individual traction elements 550 may have a width dimension W within a range from 1.5 mm to 5 mm, and in some examples, within a range from 1.75 mm to 4.5 mm or even within a range from 2 mm to 4 mm.

The traction pads 520 with integrally formed traction elements 550 may be formed, for example, by molding techniques, by three-dimensional printing techniques, or in another suitable manner. The traction pads 520 may be formed from rubber, nylon, thermoplastic polyurethanes, other thermoplastic materials, thermosetting materials, metals, or other desired materials. While the traction pad 520 may be made as a separate part from the base member 110 (and engaged with the base member 110 in any of the manners described above), the traction pad 520 may be integrally formed with at least some part of the base member 110 (e.g., by three-dimensional printing techniques). In this illustrated example, the handle 120 includes perforations (e.g., recesses or through holes), e.g., to allow better air flow to the hands to help keep the user's hands cool and/or dry. At least portions of the traction pad 520 may include perforations 500H (e.g., recesses or through holes), e.g., to allow better air flow to the hands to help keep the user's hands cool and/or dry.

Additionally or alternatively, in some other examples of this technology, the traction elements 550 of this example hand-engaging device 500 may be formed as separate elements fixed to base surface 500B. Still additionally or alternatively, if desired, two or more traction elements 550 may be formed as a unitary, one-piece structure with a traction element base (e.g., akin to element 252 described above) connecting two (or more) traction elements 550 (e.g., akin to the structures of traction element components 258 described above).

Hand-engaging devices 100, 400L, 400R, and 500 of the types described above (e.g., including traction pads 200, 420, and 520 made in accordance with examples of this technology) provide excellent traction under a variety of use conditions, e.g., wet conditions or dry conditions, hot conditions or cold conditions, particularly when engaging a pushrim 20 having a rubber, thermoplastic, and/or other polymeric outer surface material. The fee ends 250E, 450E and/or free edges 550E of the traction elements 250, 450, 550 better engage the pushrim 20 surface (particularly when provided with the angular and/or other one-way traction features) during all phases of the propulsion cycle to assist the user in propelling the vehicle. Additionally or alternatively, the recessed groove 210T features and/or the resiliency/compressibility features of the traction pads 200, 420, 520 may help better engage the pushrim 20 and/or help protect the user's hands in use.

Various components and features of hand-engaging devices in accordance with this technology are illustrated in various specific aesthetic appearances. Those skilled in the art, given benefit of this disclosure, will recognize that many variations in the aesthetic appearances of features of the hand-engaging devices may be made while still providing the desired functions for this technology. Thus, the specifically illustrated aesthetic appearances are not critical to the function of the hand-engaging components.

III. Conclusion

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

For the avoidance of doubt, the present application includes at least the subject matter described in the following numbered Clauses:

Clause 1. A hand-engaging device, comprising:

a base member including a first side configured to engage a user's hand and a second side opposite the first side; and a traction pad engaged or integrally formed with the second side of the base member, wherein the traction pad includes a base surface and a plurality of traction elements extending outward from the base surface, the plurality of traction elements including at least one of a free end or a free edge spaced apart from the base surface.

Clause 2. The hand-engaging device according to Clause 1, wherein the base surface of the traction pad includes a recessed groove defined therein, and wherein the recessed groove extends: (i) in a direction from a forward end of the base surface to a rearward end of the base surface and (ii) at least 50% of a length dimension of the traction pad measured from the forward end to the rearward end.

Clause 3. The hand-engaging device according to Clause 1, wherein the base surface of the traction pad includes a recessed groove defined therein, and wherein the recessed groove extends: (i) in a direction from a forward end of the base surface to a rearward end of the base surface and (ii) at least 75% of a length dimension of the traction pad measured from the forward end to the rearward end.

Clause 4. The hand-engaging device according to Clause 2 or 3, wherein the base surface includes a first perimeter edge extending in a direction between the forward end and the rearward end and a second perimeter edge located opposite the first perimeter edge, and wherein the recessed groove is located within a central region of the base surface between the first perimeter edge and the second perimeter edge.

Clause 5. The hand-engaging device according to any one of Clauses 2 to 4, wherein the recessed groove extends continuously from a forward groove portion to a rearward groove portion.

Clause 6. The hand-engaging device according to any one of Clauses 2 to 5, wherein a deepest part of the recessed groove is located closer to the forward end than to the rearward end.

Clause 7. The hand-engaging device according to Clause 6, wherein the recessed groove becomes continuously shallower in a rearward direction from the deepest part.

Clause 8. The hand-engaging device according to Clause 6 or 7, wherein plural traction elements located within the deepest part of the recessed groove are positioned to contact a circular tube having a cross-sectional diameter between 6 mm and 25 mm over a range spanning at least one eighth of a circumference of the circular tube.

Clause 9. The hand-engaging device according to any one of Clauses 2 to 8, wherein the base surface of the traction pad is shaped such that the recessed groove terminates before reaching the rearward end of the base surface.

Clause 10. The hand-engaging device according to any one of Clauses 2 to 9, wherein at least some of the plurality of traction elements are located within and have their free ends and/or free edges exposed within the recessed groove.

Clause 11. The hand-engaging device according to Clause 10, wherein at least 50 of the plurality of traction elements are at least partially located within and have their free ends and/or free edges exposed within the recessed groove.

Clause 12. The hand-engaging device according to any one of Clauses 1 to 11, wherein a first set of the plurality of traction elements includes the free edge spaced apart from the base surface.

Clause 13. The hand-engaging device according to Clause 12, wherein the first set of the plurality of traction elements includes at least 50% of a total number of the traction elements extending from the base surface.

Clause 14. The hand-engaging device according to Clause 12, wherein the first set of the plurality of traction elements includes at least 75% of a total number of the traction elements extending from the base surface.

Clause 15. The hand-engaging device according to Clause 12, wherein the first set of the plurality of traction elements includes at least 90% of a total number of the traction elements extending from the base surface.

Clause 16. The hand-engaging device according to any one of Clauses 12 to 15, wherein the first set of the plurality of traction elements extend away from the base surface in a forward direction with respect to the hand-engaging device such that the free edges of the traction elements of the first set are located further forward than are a corresponding base region of that traction element.

Clause 17. The hand-engaging device according to any one of Clauses 12 to 16, wherein the first set of the plurality of traction elements includes at least 100 spaced apart free edges.

Clause 18. The hand-engaging device according to any one of Clauses 12 to 16, wherein the first set of the plurality of traction elements includes at least 200 spaced apart free edges.

Clause 19. The hand-engaging device according to any one of Clauses 1 to 11, wherein a first set of the plurality of traction elements includes the free end spaced apart from the base surface.

Clause 20. The hand-engaging device according to Clause 19, wherein the first set of the plurality of traction elements includes at least 50% of a total number of the traction elements extending from the base surface.

Clause 21. The hand-engaging device according to Clause 19, wherein the first set of the plurality of traction elements includes at least 75% of a total number of the traction elements extending from the base surface.

Clause 22. The hand-engaging device according to Clause 19, wherein the first set of the plurality of traction elements includes at least 90% of a total number of the traction elements extending from the base surface.

Clause 23. The hand-engaging device according to any one of Clauses 19 to 22, wherein the first set of the plurality of traction elements extend away from the base surface in a forward direction with respect to the hand-engaging device such that the free ends of the traction elements of the first set are located further forward than are a corresponding base region of that traction element.

Clause 24. The hand-engaging device according to any one of Clauses 19 to 23, wherein the first set of the plurality of traction elements includes at least 100 spaced apart free ends.

Clause 25. The hand-engaging device according to any one of Clauses 19 to 23, wherein the first set of the plurality of traction elements includes at least 200 spaced apart free ends.

Clause 26. The hand-engaging device according to any one of Clauses 19 to 25, wherein each of the plurality of traction elements of the first set includes a cylindrical structure extending from the base surface of the traction pad to the free end of that respective traction element.

Clause 27. The hand-engaging device according to any one of Clauses 19 to 26, wherein two traction elements of the first set are formed as a one-piece structure.

Clause 28. The hand-engaging device according to Clause 27, wherein the traction pad is engaged with a mount surface of the base member located at the second side of the base member, wherein the first set of the plurality of traction elements extend away from and are spaced apart from the base surface at a first side of the base surface, and wherein the one-piece structure forming said two traction elements includes: (a) a traction element base extending along a portion of a second side of the base surface located opposite the first side of the base surface, (b) a first traction element extending away from the traction element base and through the base surface from the second side of the base surface to the first side of the base surface to a first free end of the first traction element that is spaced apart from the first side of the base surface, and (c) a second traction element extending away from the traction element base and through the base surface from the second side of the base surface to the first side of the base surface to a second free end of the second traction element that is spaced apart from the first side of the base surface.

Clause 29. The hand-engaging device according to any one of Clauses 19 to 28, wherein, with the base surface oriented flat on a horizontal support surface, the plurality of traction elements of the first set are oriented in a forward angled direction toward a forward edge of the hand-engaging device.

Clause 30. The hand-engaging device according to any one of Clauses 19 to 28, wherein, with the base surface oriented flat on a horizontal support surface, the plurality of traction elements of the first set are oriented at an angle of 1 degree to 15 degrees with respect to a vertical direction.

Clause 31. The hand-engaging device according to Clause 30, wherein the angle is between 5 degrees and 12 degrees with respect to the vertical direction.

Clause 32. The hand-engaging device according to any one of Clauses 19 to 31, wherein each traction element of the plurality of traction elements of the first set has a circular cross-section with a diameter in a range of 0.2 mm to 1.5 mm.

Clause 33. The hand-engaging device according to any one of Clauses 19 to 31, wherein each traction element of the plurality of traction elements of the first set has transverse cross-sectional shape with a largest diagonal dimension within in a range of 0.2 mm to 1.5 mm.

Clause 34. The hand-engaging device according to any one of Clauses 19 to 33, wherein each traction element of the plurality of traction elements of the first set has an exposed height dimension measured from the base surface to the free end of the respective traction element within a range of 0.5 mm to 4 mm.

Clause 35. The hand-engaging device according to any one of Clauses 19 to 34, wherein the base surface of the traction pad includes a multi-layered structure.

Clause 36. The hand-engaging device according to Clause 35, wherein the multi-layered structure includes a fabric layer and a rubber layer, wherein the plurality of traction elements extend outward from an exposed surface of the rubber layer.

Clause 37. The hand-engaging device according to any one of Clauses 1 to 36, wherein the plurality of traction elements are one-way traction elements.

Clause 38. The hand-engaging device according to Clause 37, wherein the one-way traction elements are configured such that a force required to cause relative movement between the hand-engaging device and a rubber component or a thermoplastic elastomeric component in a forward direction of the hand-engaging device is at least five times greater than a force required to cause relative movement between the hand-engaging device and the rubber component or the thermoplastic elastomer component in a rearward direction of the hand-engaging device.

Clause 39. The hand-engaging device according to any one of Clauses 1 to 38, wherein the first side of the base member includes a handle and a thumb-receiving chamber.

Clause 40. The hand-engaging device according to Clause 39, wherein the first side of the base member additionally includes a receptacle configured to receive an end of at least one additional finger, wherein the receptacle is located between an outer surface of the handle and the traction pad.

Clause 41. The hand-engaging device according to Clause 39, wherein the first side of the base member additionally includes a receptacle configured to receive ends of only two fingers, wherein the receptacle is located between an outer surface of the handle and the traction pad.

Clause 42. The hand-engaging device according to any one of Clauses 39 to 41, further comprising a securing strap that extends from a location adjacent the thumb-receiving chamber to a free end of the handle.

Clause 43. The hand-engaging device according to any one of Clauses 39 to 42, wherein multiple perforations extend through the handle.

Clause 44. The hand-engaging device according to any one of Clauses 39 to 43, wherein the handle includes an outer surface comprising an elastomeric material.

Clause 45. The hand-engaging device according to any one of Clauses 39 to 44, wherein the handle includes a portion that extends outward beyond a first side edge of the traction pad.

Clause 46. The hand-engaging device according to Clause 45, wherein the handle includes at least one finger-engaging groove located on the portion of the handle that extends outward beyond the first side edge of the traction pad.

Clause 47. The hand-engaging device according to any one of Clauses 1 to 46, further comprising a fluid-filled bladder located between the base surface of the traction pad and the second side of the base member.

Clause 48. The hand-engaging device according to any one of Clauses 1 to 47, wherein the second side of the base member includes plural openings and/or recesses formed therein.

Clause 49. The hand-engaging device according to Clause 48, wherein the plural openings and/or recesses are arranged in a lattice structure.

Clause 50. The hand-engaging device according to Clause 48 or 49, further comprising a cover member engaged with the base member and covering at least some of the plural openings and/or recesses.

Clause 51. The hand-engaging device according to Clause 50, wherein plural openings are defined through the cover member.

Clause 52. The hand-engaging device according to any one of Clauses 1 to 51, wherein, for at least 25% of the plurality of traction elements, the free ends and/or free edges of the plurality of traction elements are located within a range of 1.5 mm to 5 mm from the free end and/or free edge of a nearest adjacent traction element.

Clause 53. The hand-engaging device according to any-one of Clauses 1 to 52, wherein the plurality of traction elements are arranged in an average packing density of at least 5 traction elements per square centimeter over an area of the base surface of at least 25 $cm^2$.

Clause 54. The hand-engaging device according to any-one of Clauses 1 to 52, wherein the plurality of traction elements are arranged in an average packing density of at least 8 traction elements per square centimeter over an area of the base surface of at least 25 $cm^2$.

Clause 55. A hand-engaging device, comprising:

a base member including a first side configured to engage a user's hand and a second side opposite the first side, wherein the second side includes a mount surface; and a traction pad engaged with the mount surface, wherein the traction pad includes a base surface and a plurality of traction elements extending outward from a first side of the base surface, wherein a first set of the plurality of traction elements includes plural traction element components having a one-piece structure, the one-piece structure comprising:

(a) a traction element base extending along a portion of a second side of the base surface located opposite the first side of the base surface, (b) a first traction element extending away from the traction element base and through the base surface from the second side of the base surface to the first side of the base surface and to a first free end of the first traction element that is spaced apart from the first side of the base surface, and (c) a second traction element extending away from the traction element base and through the base surface from the second side of the base surface to the first side of the base surface and to a second free end of the second traction element that is spaced apart from the first side of the base surface.

Clause 56. The hand-engaging device according to Clause 55, wherein the first set of the plurality of traction elements includes at least 50 traction element components having the one-piece structure.

Clause 57. The hand-engaging device according to Clause 55, wherein the first set of the plurality of traction elements includes at least 100 traction element components having the one-piece structure.

Clause 58. The hand-engaging device according to Clause 55, wherein the first set of the plurality of traction elements includes at least 250 traction element components having the one-piece structure.

Clause 59. The hand-engaging device according to any one of Clauses 55 to 58, wherein the traction element bases of the traction element components are arranged in one or more rows at the second side of the base surface.

Clause 60. The hand-engaging device according to any one of Clauses 55 to 58, wherein the traction element bases of the traction element components are arranged in plural rows at the second side of the base surface.

Clause 61. The hand-engaging device according to Clause 60, wherein a first row of the traction element components is separated from an adjacent second row of the traction element components by a spacing in a range of 1.5 mm to 5 mm.

Clause 62. The hand-engaging device according to any one of Clauses 59 to 61, wherein within a single row of the traction element components, a traction element base of one traction element component in the single row is separated from a traction element base of an immediately adjacent traction element component within the single row by a spacing of less than 3 mm.

Clause 63. The hand-engaging device according to any one of Clauses 55 to 62, wherein in the one-piece structure, the first traction element and the second traction element extend parallel to one another.

Clause 64. The hand-engaging device according to any one of Clauses 55 to 63, wherein the base surface of the traction pad includes a recessed groove defined therein, and wherein the recessed groove extends: (i) in a direction from a forward end of the base surface to a rearward end of the base surface and (ii) at least 50% of a length dimension of the traction pad measured from the forward end to the rearward end.

Clause 65. The hand-engaging device according to any one of Clauses 55 to 63, wherein the base surface of the traction pad includes a recessed groove defined therein, and wherein the recessed groove extends: (i) in a direction from a forward end of the base surface to a rearward end of the base surface and (ii) at least 75% of a length dimension of the traction pad measured from the forward end to the rearward end.

Clause 66. The hand-engaging device according to Clause 64 or 65, wherein the base surface includes a first perimeter edge extending in a direction between the forward end and the rearward end and a second perimeter edge located opposite the first perimeter edge, and wherein the recessed groove is located within a central region of the base surface between the first perimeter edge and the second perimeter edge.

Clause 67. The hand-engaging device according to any one of Clauses 64 to 66, wherein the recessed groove extends continuously from a forward groove portion to a rearward groove portion.

Clause 68. The hand-engaging device according to any one of Clauses 64 to 67, wherein a deepest part of the recessed groove is located closer to the forward end than to the rearward end.

Clause 69. The hand-engaging device according to Clause 68, wherein the recessed groove becomes continuously shallower in a rearward direction from the deepest part.

Clause 70. The hand-engaging device according to Clause 68 or 69, wherein plural traction elements having the one-piece structure are located within the deepest part of the recessed groove and are positioned to contact a circular tube having a cross-sectional diameter between 6 mm and 25 mm over a range spanning at least one eighth of a circumference of the circular tube.

Clause 71. The hand-engaging device according to any one of Clauses 64 to 70, wherein the base surface of the traction pad is shaped such that the recessed groove terminates before reaching the rearward end of the base surface.

Clause 72. The hand-engaging device according to any one of Clauses 64 to 71, wherein at least some of the traction element components having the one-piece structure are located within and have their first free end and their second free end exposed within the recessed groove.

Clause 73. The hand-engaging device according to Clause 72, wherein at least 25 of the traction element components having the one-piece structure are at least partially located within and have their first free end and their second free end exposed within the recessed groove.

Clause 74. The hand-engaging device according to any one of Clauses 55 to 73, wherein the traction element components having the one-piece structure include at least 50% of a total number of the traction elements extending from the base surface.

Clause 75. The hand-engaging device according to any one of Clauses 55 to 73, wherein the traction element components having the one-piece structure include at least 75% of a total number of the traction elements extending from the base surface.

Clause 76. The hand-engaging device according to any one of Clauses 55 to 73, wherein the traction element components having the one-piece structure include at least 90% of a total number of the traction elements extending from the base surface.

Clause 77. The hand-engaging device according to any one of Clauses 74 to 76, wherein the traction element components having the one-piece structure extend away from the base surface in a forward direction with respect to the hand-engaging device such that the first free ends and the second free ends of the traction element components are located further forward than are a corresponding traction element base of that traction element component.

Clause 78. The hand-engaging device according to any one of Clauses 74 to 77, wherein the first set of the plurality of traction elements includes at least 50 spaced apart traction element components having the one-piece structure.

Clause 79. The hand-engaging device according to any one of Clauses 74 to 77, wherein the first set of the plurality of traction elements includes at least 100 spaced apart traction element components having the one-piece structure.

Clause 80. The hand-engaging device according to any one of Clauses 74 to 79, wherein in the one-piece structure: (i) the first traction element includes a cylindrical structure extending from the base surface of the traction pad to the first free end, and/or (ii) the second traction element includes a cylindrical structure extending from the base surface of the traction pad to the second free end.

Clause 81. The hand-engaging device according to any one of Clauses 74 to 80, wherein in the one-piece structure, with the base surface oriented flat on a horizontal support surface, the first traction element and the second traction element are oriented in a forward angled direction toward a forward edge of the hand-engaging device.

Clause 82. The hand-engaging device according to any one of Clauses 74 to 81, wherein in the one-piece structure, with the base surface oriented flat on a horizontal support surface, the first traction element and the second traction element are oriented at an angle of 1 degree to 15 degrees with respect to a vertical direction.

Clause 83. The hand-engaging device according to Clause 82, wherein the angle is between 5 degrees and 12 degrees with respect to the vertical direction.

Clause 84. The hand-engaging device according to any one of Clauses 74 to 83, wherein in the one-piece structure, at least one of the first traction element or the second traction element has a circular cross-section with a diameter in a range of 0.2 mm to 1.5 mm.

Clause 85. The hand-engaging device according to any one of Clauses 74 to 83, wherein in the one-piece structure, at least one of the first traction element or the second traction element has a transverse cross-sectional shape with a largest diagonal dimension within a range of 0.2 mm to 1.5 mm.

Clause 86. The hand-engaging device according to any one of Clauses 74 to 85, wherein in the one-piece structure, the first traction element has an exposed height dimension measured from the base surface to the first free end within a range of 0.5 mm to 4 mm and/or the second traction element has an exposed height dimension measured from the base surface to the second free end within a range of 0.5 mm to 4 mm.

Clause 87. The hand-engaging device according to any one of Clauses 55 to 86, wherein the base surface of the traction pad includes a multi-layered structure.

Clause 88. The hand-engaging device according to Clause 87, wherein the multi-layered structure includes a fabric layer and a rubber layer, wherein the plurality of traction elements extend outward from an exposed surface of the rubber layer.

Clause 89. The hand-engaging device according to any one of Clauses 55 to 88, wherein the first set of the plurality of traction elements are one-way traction elements.

Clause 90. The hand-engaging device according to Clause 89, wherein the one-way traction elements are configured such that a force required to cause relative movement between the hand-engaging device and a rubber component or a thermoplastic elastomeric component in a forward direction of the hand-engaging device is at least five times greater than a force required to cause relative movement between the hand-engaging device and the rubber component or the thermoplastic elastomer component in a rearward direction of the hand-engaging device.

Clause 91. The hand-engaging device according to any one of Clauses 55 to 90, wherein the first side of the base member includes a handle and a thumb-receiving chamber.

Clause 92. The hand-engaging device according to Clause 91, wherein the first side of the base member additionally includes a receptacle configured to receive an end of at least one additional finger, wherein the receptacle is located between an outer surface of the handle and the traction pad.

Clause 93. The hand-engaging device according to Clause 91, wherein the first side of the base member additionally includes a receptacle configured to receive ends of only two fingers, wherein the receptacle is located between an outer surface of the handle and the traction pad.

Clause 94. The hand-engaging device according to any one of Clauses 91 to 93, further comprising a securing strap that extends from a location adjacent the thumb-receiving chamber to a free end of the handle.

Clause 95. The hand-engaging device according to any one of Clauses 91 to 94, wherein multiple perforations extend through the handle.

Clause 96. The hand-engaging device according to any one of Clauses 91 to 95, wherein the handle includes an outer surface comprising an elastomeric material.

Clause 97. The hand-engaging device according to any one of Clauses 91 to 96, wherein the handle includes a portion that extends outward beyond a first side edge of the mount surface.

Clause 98. The hand-engaging device according to Clause 97, wherein the handle includes at least one finger-engaging groove located on the portion of the handle that extends outward beyond the first side edge of the mount surface.

Clause 99. The hand-engaging device according to any one of Clauses 55 to 98, further comprising a fluid-filled bladder located between the base surface of the traction pad and the second side of the base member.

Clause 100. The hand-engaging device according to any one of Clauses 55 to 99, wherein the mount surface of the base member includes plural openings and/or recesses formed therein.

Clause 101. The hand-engaging device according to Clause 100, wherein the plural openings and/or recesses are arranged in a lattice structure.

Clause 102. The hand-engaging device according to Clause 100 or 101, further comprising a cover member engaged with the base member and covering at least some of the plural openings and/or recesses.

Clause 103. The hand-engaging device according to Clause 102, wherein plural openings are defined through the cover member.

Clause 104. The hand-engaging device according to any one of Clauses 55 to 103, wherein the traction element components having the one-piece structure are arranged in an average packing density of at least 2 traction element components having the one-piece structure per square centimeter over an area of the base surface of at least 25 $cm^2$.

Clause 105. The hand-engaging device according to any one of Clauses 55 to 103, wherein the traction element components having the one-piece structure are arranged in an average packing density of at least 4 traction element components having the one-piece structure per square centimeter over an area of the base surface of at least 25 $cm^2$.

Clause 106. The hand-engaging device according to any one of Clauses 55 to 105, wherein in the one-piece structure, the first free end is separated from the second free end by a spacing dimension within a range of 1.5 mm to 5 mm.

Clause 107. The hand-engaging device according to any one of Clauses 55 to 106, wherein the first traction element has common size and shape features with the second traction element.

Clause 108. The hand-engaging device according to any one of Clauses 55 to 107, wherein all traction element components of the first set having the one-piece structure have common size and shape features.

What is claimed is:

1. A hand-engaging device, comprising:

a base member including: (a) a first side including a thumb-receiving chamber and a handle, wherein the first side is configured to engage a user's hand, and (b) a second side opposite the first side; and a traction pad engaged or integrally formed with the second side of the base member, wherein the traction pad includes a base surface and a plurality of traction elements extending outward from the base surface, the plurality of traction elements including at least one of a free end or a free edge spaced apart from the base surface, wherein a first set of the plurality of traction elements includes the free end spaced apart from the base surface, wherein the first set of the plurality of traction elements extend away from the base surface in a forward direction with respect to the band-engaging device such that the free ends of the traction elements of the first set are located further forward than are a corresponding base region of that traction element, and wherein the handle is positioned with respect to the traction pad to define a receptacle that is located between an outer surface of the handle and the traction pad, the receptacle being configured to receive at least one finger of the user's hand when the user grasps the handle.

2. The hand-engaging device according to claim 1, wherein the first set of the plurality of traction elements includes at least 100 spaced apart free ends.

3. The hand-engaging device according to claim 1, wherein two traction elements of the first set are formed as a one-piece structure.

4. A hand-engaging device, comprising:

a base member including: (a) a first side including a thumb-receiving chamber and a handle, wherein the first side is configured to engage a user's hand, and (b) a second side opposite the first side; and a traction pad engaged or integrally formed with the second side of the base member, wherein the traction pad includes a base surface and a plurality of traction elements extending outward from the base surface, the plurality of traction elements including at least one of a free end or a free edge spaced apart from the base surface, wherein the base surface of the traction pad includes a recessed groove defined therein, and wherein the recessed groove extends: (i) in a direction from a forward end of the base surface to a rearward end of the base surface and (ii) at least 50% of a length dimension of the traction pad measured from the forward end to the rearward end, wherein the handle is positioned with respect to the traction pad to define a receptacle that is located between an outer surface of the handle and the traction pad, the receptacle being configured to receive at least one finger of the user's hand when the user grasps the handle.

5. The hand-engaging device according to claim 4, wherein the base surface includes a first perimeter edge extending in a direction between the forward end and the rearward end and a second perimeter edge located opposite the first perimeter edge, wherein the recessed groove is located within a central region of the base surface between the first perimeter edge and the second perimeter edge, wherein the recessed groove extends continuously from a forward groove portion to a rearward groove portion, and wherein a deepest part of the recessed groove is located closer to the forward end than to the rearward end.

6. The hand-engaging device according to claim 5, wherein plural traction elements located within the deepest part of the recessed groove are positioned to contact a circular tube having a cross-sectional diameter between 6 mm and 25 mm over a range spanning at least one eighth of a circumference of the circular tube.

7. The hand-engaging device according to claim 4, wherein at least 50 of the plurality of traction elements are at least partially located within and have their free ends and/or free edges exposed within the recessed groove.

8. A hand-engaging device, comprising:

a base member including: (a) a first side including a thumb-receiving chamber and a handle, wherein the first side is configured to engage a user's hand, and (b) a second side opposite the first side; and a traction pad engaged or integrally formed with the second side of the base member, wherein the traction pad includes a base surface and a plurality of traction elements extending outward from the base surface, the plurality of traction elements including at least one of a free end or a free edge spaced apart from the base surface, wherein the base surface of the traction pad includes a multi-layered structure, wherein the multi-layered structure includes an inner fabric layer and an outer rubber layer, wherein a first set of the plurality of traction elements includes the free end spaced apart from the base surface, and wherein each of the plurality of traction elements of the first set includes a cylindrical structure extending: (i) through the inner fabric layer and the outer rubber layer and (ii) outward from an exposed surface of the outer rubber layer to the free end of that respective traction element, and wherein the handle is positioned with respect to the traction pad to define a receptacle that is located between an outer surface of the handle and the traction pad, the receptacle being configured to receive at least one finger of the user's hand when the user grasps the handle.

9. A hand-engaging device, comprising:

a base member including: (a) a first side including a thumb-receiving chamber and a handle, wherein the first side is configured to engage a user's hand, and (b) a second side opposite the first side; and a traction pad engaged or integrally formed with the second side of the base member, wherein the traction pad includes a base surface and a plurality of traction elements extending outward from the base surface, the plurality of traction elements including at least one of a free end or a free edge spaced apart from the base surface, wherein the plurality of traction elements are one-way traction elements, and wherein the one-way traction elements are configured such that a force required to cause relative movement between the hand-engaging device and a rubber component or a thermoplastic elastomeric component in a forward direction of the hand-engaging device is at least five times greater than a force required to cause relative movement between the hand-engaging device and the rubber component or the thermoplastic elastomer component in a rearward direction of the hand-engaging device, and wherein the handle is positioned with respect to the traction pad to define a receptacle that is located between an outer surface of the handle and the traction pad, the receptacle being configured to receive at least one finger of the user's hand when the user grasps the handle.

10. The hand-engaging device according to claim 9, wherein a first set of the plurality of traction elements includes the free end spaced apart from the base surface, wherein the first set of the plurality of traction elements extend away from the base surface in a forward direction with respect to the hand-engaging device such that the free ends of the traction elements of the first set are located further forward than are a corresponding base region of that traction element.

11. A hand-engaging device, comprising:

a base member including: (a) a first side including a thumb-receiving chamber and a handle, wherein the first side is configured to engage a user's hand, and (b) a second side opposite the first side, wherein the second side includes a mount surface; and a traction pad engaged with the mount surface, wherein the traction pad includes a base surface and a plurality of traction elements extending outward from a first side of the base surface, wherein a first set of the plurality of traction elements includes plural traction element components having a one-piece structure, the one-piece structure comprising:

(a) a traction element base extending along a portion of a second side of the base surface located opposite the first side of the base surface, (b) a first traction element extending away from the traction element base and through the base surface from the second side of the base surface to the first side of the base surface and to a first free end of the first traction element that is spaced apart from the first side of the base surface, and (c) a second traction element extending away from the traction element base and through the base surface from the second side of the base surface to the first side of the base surface and to a second free end of the second traction element that is spaced apart from the first side of the base surface, and wherein the handle is positioned with respect to the traction pad to define a receptacle that is located between an outer surface of the handle and the traction pad, the receptacle being configured to receive at least one finger of the user's hand when the user grasps the handle.

12. The hand-engaging device according to claim 11, wherein the first set of the plurality of traction elements includes at least 50 traction element components having the one-piece structure.

13. The hand-engaging device according to claim 11, wherein the traction element bases of the traction element components are arranged in plural rows at the second side of the base surface.

14. The hand-engaging device according to claim 13, wherein a first row of the traction element components is separated from an adjacent second row of the traction element components by a spacing in a range of 1.5 mm to 5 mm, and wherein within a single row of the traction element components, a traction element base of one traction element component in the single row is separated from a traction element base of an immediately adjacent traction element component within the single row by a spacing of less than 3 mm.

15. The hand-engaging device according to claim 11, wherein the traction element components having the one-piece structure extend away from the base surface in a forward direction with respect to the hand-engaging device such that the first free ends and the second free ends of the traction element components are located further forward than are a corresponding traction element base of that traction element component.

16. The hand-engaging device according to claim 11, wherein in the one-piece structure: (i) the first traction element includes a cylindrical structure extending from the base surface of the traction pad to the first free end, and/or (ii) the second traction element includes a cylindrical structure extending from the base surface of the traction pad to the second free end.

17. The hand-engaging device according to claim 11, wherein in the one-piece structure, with the base surface oriented flat on a horizontal support surface, the first traction element and the second traction element are oriented at an angle between 5 degrees and 12 degrees with respect to a vertical direction.

18. The hand-engaging device according to claim 11, wherein in the one-piece structure, at least one of the first traction element or the second traction element has a circular cross-section with a diameter in a range of 0.2 mm to 1.5 mm, and wherein in the one-piece structure: (i) the first traction element has an exposed height dimension measured from the base surface to the first free end within a range of 0.5 mm to 4 mm and/or (ii) the second traction element has an exposed height dimension measured from the base surface to the second free end within a range of 0.5 mm to 4 mm.

19. The hand-engaging device according to claim 11, wherein the base surface of the traction pad includes a multi-layered structure, wherein the multi-layered structure includes an inner fabric layer and an outer rubber layer, and wherein in the one-piece structure: (i) the traction element base extends along the inner fabric layer, (ii) each of the first traction element and the second traction element extends through the inner fabric layer and the outer rubber layer, and (iii) each of the first traction element and the second traction element extends outward from an exposed surface of the outer rubber layer.

20. A hand-engaging device, comprising:

a base member including a first side configured to engage a user's hand and a second side opposite the first side, wherein the second side includes a mount surface;

a traction pad engaged with the mount surface, wherein the traction pad includes a base surface and a plurality of traction elements extending outward from a first side of the base surface, wherein a first set of the plurality of traction elements includes plural traction element components having a one-piece structure, the one-piece structure comprising:

(a) a traction element base extending along a portion of a second side of the base surface located opposite the first side of the base surface, (b) a first traction element extending away from the traction element base and through the base surface from the second side of the base surface to the first side of the base surface and to a first free end of the first traction element that is spaced apart from the first side of the base surface, and (c) a second traction element extending away from the traction element base and through the base surface from the second side of the base surface to the first side of the base surface and to a second free end of the second traction element that is spaced apart from the first side of the base surface; and a fluid-filled bladder located between the base surface of the traction pad and the second side of the base member.

* * * * *